US010748684B2

(12) United States Patent
Ito et al.

(10) Patent No.: US 10,748,684 B2
(45) Date of Patent: Aug. 18, 2020

(54) RARE-EARTH MAGNET AND METHOD FOR MANUFACTURING SAME

(71) Applicant: TOYOTA JIDOSHA KABUSHIKI KAISHA, Aichi-ken (JP)

(72) Inventors: Masaaki Ito, Susono (JP); Masao Yano, Shizouka (JP); Hidefumi Kishimoto, Shizuoka (JP); Noritsugu Sakuma, Mishima (JP); Tetsuya Shoji, Toyota (JP); Akira Manabe, Miyoshi (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 0 days.

(21) Appl. No.: 16/532,651

(22) Filed: Aug. 6, 2019

(65) Prior Publication Data

US 2019/0362870 A1 Nov. 28, 2019

Related U.S. Application Data

(62) Division of application No. 14/896,215, filed as application No. PCT/JP2014/064995 on Jun. 5, 2014, now Pat. No. 10,468,165.

(30) Foreign Application Priority Data

Jun. 5, 2013 (JP) ..... 2013-118893

(51) Int. Cl.
*H01F 41/02* (2006.01)
*B22F 3/14* (2006.01)
(Continued)

(52) U.S. Cl.
CPC ..... *H01F 1/0551* (2013.01); *C22C 33/02* (2013.01); *C22C 38/00* (2013.01); *C22C 38/002* (2013.01);
(Continued)

(58) Field of Classification Search
None
See application file for complete search history.

(56) References Cited

U.S. PATENT DOCUMENTS 4,792,367 A 12/1988 Lee
5,129,963 A 7/1992 Panchanathan et al.
(Continued)

FOREIGN PATENT DOCUMENTS

CN 1234589 A 11/1999
CN 1358595 A 7/2002
(Continued)

OTHER PUBLICATIONS

Corrected Notice of Allowability dated Jan. 6, 2016 from the United States Patent and Trademark Office issued in U.S. Appl. No. 13/750,576.
(Continued)

*Primary Examiner* — Xiaowei Su
(74) *Attorney, Agent, or Firm* — Sughrue MIon, PLLC

(57) ABSTRACT

To provide a rare earth magnet ensuring excellent magnetic anisotropy while reducing the amount of Nd, etc., and a manufacturing method thereof.

A rare earth magnet comprising a crystal grain having an overall composition of $(R2_{(1-x)}R1_x)_yFe_{100-y-w-z-v}Co_wB_zTM_v$ (wherein R2 is at least one of Nd, Pr, Dy and Tb, R1 is an alloy of at least one or two or more of Ce, La, Gd, Y and Sc, TM is at least one of Ga, Al, Cu, Au, Ag, Zn, In and Mn, $0<x<1$, y=12 to 20, z=5.6 to 6.5, w=0 to 8, and v=0 to 2), wherein the average grain size of the crystal grain is 1,000 nm or less, the crystal grain consists of a core and an outer shell, the core has a composition of R1 that is richer than R2, and the outer shell has a composition of R2 that is richer than R1.

12 Claims, 21 Drawing Sheets

(51) Int. Cl.

| | |
|---|---|
| ***H01F 1/055*** | (2006.01) |
| ***C22C 33/02*** | (2006.01) |
| ***C22C 38/00*** | (2006.01) |
| ***H01F 1/057*** | (2006.01) |
| ***C22C 38/10*** | (2006.01) |
| *B22F 5/00* | (2006.01) |

(52) U.S. Cl.

CPC ..... *C22C 38/005* (2013.01); *C22C 38/10* (2013.01); *H01F 1/0572* (2013.01); *H01F 41/0266* (2013.01); *H01F 41/0293* (2013.01); *B22F 3/14* (2013.01); *B22F 5/00* (2013.01); *B22F 2003/145* (2013.01); *B22F 2207/01* (2013.01); *B22F 2301/45* (2013.01); *B22F 2998/10* (2013.01); *B22F 2999/00* (2013.01); *C22C 2202/04* (2013.01); *H01F 1/0576* (2013.01)

(56) References Cited

U.S. PATENT DOCUMENTS

| | | | | |
|---|---|---|---|---|
| 5,641,363 | A | 6/1997 | Fukuno et al. | |
| 6,319,335 | B1 | 11/2001 | Hirota et al. | |
| 8,846,136 | B2 | 9/2014 | Shoji et al. | |
| 9,188,039 | B2 | 11/2015 | Nagel et al. | |
| 9,257,227 | B2 | 2/2016 | Haga et al. | |
| 2003/0136469 | A1 | 7/2003 | Makita et al. | |
| 2005/0268989 | A1 | 12/2005 | Tomizawa et al. | |
| 2005/0284545 | A1 | 12/2005 | Komuro et al. | |
| 2006/0022175 | A1 | 2/2006 | Komuro et al. | |
| 2006/0054245 | A1 | 3/2006 | Liu et al. | |
| 2006/0278517 | A1 | 12/2006 | Machida et al. | |
| 2007/0240789 | A1 | 10/2007 | Nakamura et al. | |
| 2008/0223489 | A1 | 9/2008 | Nagata et al. | |
| 2009/0020193 | A1 | 1/2009 | Ohta et al. | |
| 2010/0003156 | A1 | 1/2010 | Suzuki et al. | |
| 2011/0000586 | A1 | 1/2011 | Nomura et al. | |
| 2011/0036460 | A1 | 2/2011 | Nagata et al. | |
| 2011/0090032 | A1 | 4/2011 | Nagata et al. | |
| 2012/0114515 | A1 | 5/2012 | Kaneko et al. | |
| 2012/0299675 | A1 | 11/2012 | Honkura et al. | |
| 2012/0312422 | A1 | 12/2012 | Yano et al. | |
| 2013/0009736 | A1 | 1/2013 | Honkura et al. | |
| 2013/0078369 | A1* | 3/2013 | Shoji | C22C 38/005 427/127 |
| 2013/0139505 | A1 | 6/2013 | Nagel et al. | |
| 2013/0195710 | A1 | 8/2013 | Haga et al. | |
| 2014/0105779 | A1 | 4/2014 | Nakamura | |
| 2014/0242267 | A1 | 8/2014 | Shoji et al. | |
| 2014/0283649 | A1 | 9/2014 | Kunieda et al. | |
| 2014/0308441 | A1 | 10/2014 | Shoji et al. | |
| 2014/0311291 | A1* | 10/2014 | Enokido | H01F 1/0577 75/246 |
| 2015/0228386 | A1 | 8/2015 | Sakuma et al. | |
| 2015/0235747 | A1 | 8/2015 | Moyamoto et al. | |
| 2015/0279529 | A1 | 10/2015 | Ichigozaki et al. | |
| 2015/0279559 | A1 | 10/2015 | Miyamoto et al. | |
| 2015/0287528 | A1 | 10/2015 | Haga et al. | |
| 2016/0027564 | A1* | 1/2016 | Une | B22F 1/0044 419/30 |
| 2016/0141083 | A1 | 5/2016 | Ito et al. | |

FOREIGN PATENT DOCUMENTS

| | | | |
|---|---|---|---|
| CN | 100416719 | C | 9/2008 |
| CN | 101521068 | A | 9/2009 |
| CN | 101640087 | A | 2/2010 |
| CN | 102610347 | A | 7/2012 |
| CN | 102648502 | A | 8/2012 |
| CN | 103227019 | A | 7/2013 |
| EP | 1970924 | A1 | 9/2008 |
| JP | 02047815 | A | 2/1990 |
| JP | 2-208902 | A | 8/1990 |
| JP | H05-182851 | A | 7/1993 |
| JP | 6231926 | A | 8/1994 |
| JP | 07283016 | A1 | 10/1995 |
| JP | 8-250356 | A | 9/1996 |
| JP | 8-316014 | A | 11/1996 |
| JP | 9-275004 | A | 10/1997 |
| JP | 2693601 | B2 | 12/1997 |
| JP | H10-172850 | A | 6/1998 |
| JP | H11-329810 | A | 11/1999 |
| JP | 3033127 | B2 | 4/2000 |
| JP | 2002-144328 | A | 5/2002 |
| JP | 2003-229306 | A | 8/2003 |
| JP | 2005-209932 | A | 8/2005 |
| JP | 2007517414 | A | 6/2007 |
| JP | 2007-524986 | A | 8/2007 |
| JP | 2008-235343 | A | 10/2008 |
| JP | 2008-263179 | A | 10/2008 |
| JP | 4482769 | B2 | 10/2008 |
| JP | 2009-043813 | A | 2/2009 |
| JP | 2010-074084 | A | 4/2010 |
| JP | 2010-98115 | A | 4/2010 |
| JP | 2010-114200 | A | 5/2010 |
| JP | 2010-263172 | A | 11/2010 |
| JP | 2011-014668 | A | 1/2011 |
| JP | 2011-035001 | A | 2/2011 |
| JP | 2011-061038 | A | 3/2011 |
| JP | 4656323 | B2 | 3/2011 |
| JP | 2011-82467 | A | 4/2011 |
| JP | 2011-159733 | A | 8/2011 |
| JP | 4748163 | B2 | 8/2011 |
| JP | 2012-43968 | A | 3/2012 |
| JP | 2012-234985 | A | 11/2012 |
| JP | 2013-105903 | A | 5/2013 |
| JP | 5196080 | B2 | 5/2013 |
| JP | 2013-110387 | A | 6/2013 |
| JP | 2013-175705 | A | 9/2013 |
| JP | 2014-216339 | A | 11/2014 |
| KR | 10-2012-0135337 | A | 12/2012 |
| WO | 2004/072311 | A2 | 8/2004 |
| WO | 2004081954 | A1 | 9/2004 |
| WO | 2005066980 | A1 | 7/2005 |
| WO | 2011/043158 | A1 | 4/2011 |
| WO | 2011-070827 | A1 | 6/2011 |
| WO | 2012/008623 | A1 | 1/2012 |
| WO | 2012/036294 | A1 | 3/2012 |

OTHER PUBLICATIONS

Communication dated Apr. 12, 2017 from the United States Patent and Trademark Office in U.S. Appl. No. 14/610,229.

Communication dated Dec. 12, 2016, from the United States Patent and Trademark Office issued in U.S. Appl. No. 14/441,695, 13 pages.

Communication dated Dec. 12, 2016, from the United States Patent and Trademark Office issued in U.S. Appl. No. 14/610,229, 31 pages.

Communication dated Jan. 26, 2018 from the United States Patent and Trademark Office in U.S. Appl. No. 14/610,229.

Communication dated Jul. 16, 2015 from the United States Patent and Trademark Office in U.S. Appl. No. 13/750,576.

Communication dated Mar. 2, 2017, from the United States Patent and Trademark Office in U.S. Appl. No. 14/437,898.

Communication from United States Patent and Trademark Office dated Jul. 25, 2016 in U.S. Appl. No. 14/441,695.

Communication from United States Patent and Trademark Office dated Jul. 29, 2016 in U.S. Appl. No. 14/4610,229.

Communication dated Apr. 12, 2017 from the U.S. Patent and Trademark Office in U.S. Appl. No. 14/610,229.

Decision to Grant a Patent in JP Application No. 2015-521489 dated Jun. 20, 2018. 5 pages.

Fukagawa et al.,"Nd/NdFeB Artificial Interface Microstructure and the Intrinsic Coercivity of Surface $Nd_2Fe_{14}B$ Grains", Neomax Company, 2008, vol. 24, pp. 40-45.

Fukagawa et al.,"The effect of oxygen on the surface coercivity of Nd—Fe—B sintered magnets", Journal of Applied Physics, 2009, vol. 105, 07A724, 3 pages total.

(56) References Cited

OTHER PUBLICATIONS

Hirosawa et al., "Recent Efforts Toward Rare-Metal-Free Permanent Magnets in Japan", REPM 10-, pp. 187-192.
International Search Report for PCT/JP2013/080691 dated Dec. 17, 2013.
International Search Report of PCT/JP2014/064995, dated Sep. 22, 2014. [PCT/ISA/210].
Komuro et al., "Structure and magnetic properties of NdFeB powder surrounded with layer of rare-earth fluorides", Journal of Applied Physics, 2008, vol. 103, 3 pages total.
Li et al., "The role of Cu addition in the coercivity enhancement of sintered Nd—Fe—B permanent magnets", J. Mater. Res., Feb. 2009, vol. 24, No. 2, pp. 413-419.
Liu et al., Increased coercivity in sintered Nd—Fe—B magnets with NdF3 additions and the related grain boundary phase, Scripta Materialia, 2009, vol. 61, pp. 1048-1051.
Makita et al., "Boundary Structure and the Local Crystalline Electric Field of Nd—Fe—B Sintered Magnets", 2002, vol. 26, pp. 1060-1067.
Mishima et al., "Development of a Dy-Free NdFeB Anisotropic Bonded Magnet with a High Thermal Satbility", REPM 10, pp. 253-256.
Mo et al., "Dependence of the crystal structure of the Nd-rich phase on oxygen content in an Nd—Fe—B sintered magnet", Scripta Materialia, Mar. 2008, vol. 59, pp. 179-182.
Notice of Allowance dated Jun. 19, 2014 from U.S. Patent & Trademark Office in U.S. Appl. No. 13/700,601.
Notice of Allowance from the United States Patent and Trademark Office dated Sep. 30, 2015 in U.S. Appl. No. 13/750,576.
Notification of Refusal for JP Application No. 2015-521489 dated Oct. 28, 2016, 7 pages.
Office Action dated Aug. 10, 2016 from U.S. Patent & Trademark Office in U.S. Appl. No. 14/237,702.
Office Action dated Aug. 23, 2017 from U.S. Patent & Trademark Office in U.S. Appl. No. 14/237,702.
Office Action dated Dec. 29, 2016 from U.S. Patent & Trademark Office in U.S. Appl. No. 14/237,702.
Office Action dated Jan. 16, 2014 from U.S. Patent & Trademark Office in U.S. Appl. No. 13/700,601.
Office Action dated Jul. 16, 2013 from U.S. Patent & Trademark Office in U.S. Appl. No. 13/700,601.
Office Action dated Oct. 2, 2017 from U.S. Patent & Trademark Office in U.S. Appl. No. 14/610,229.
Requirement for Restriction/Election dated Apr. 26, 2016 from U.S. Patent & Trademark Office in U.S. Appl. No. 14/237,702.
S. Hirosawa et al., "Recent Efforts Toward Rare-Metal-Free Permanent Magnets in Japan", RERM' 10 Proceedings of the 21st Workshop on Rare-Earth Permanent Magnets and their Applications, 2010, pp. 187-192 (total 7 pages).
Translation of JP 2005-209932.
Machine Translation of JP06231926 A, Aug. 19, 1994.
R. W. Lee, "Hot-pressed neodymium-iron-boron magnets", Applied Physics Letters, Apr. 15, 1985, vol. 46, No. 8, pp. 790-791 (3 pages total).
K. Hono, et al., "Strategy for high-coercivity Nd—Fe—B magnets", Scripta Materialia, 2012, vol. 67, No. 6, pp. 530-535 (6 pages total).
H. Sun, et al., "Coercivity enhancement in Nd—Fe—B sintered permanent magnet doped with Pr nanoparticles", Journal of Applied Physics, 2011, vol. 109, pp. 07A749-1-07A749-3 (4 pages total).

* cited by examiner

RARE-EARTH MAGNET AND METHOD FOR MANUFACTURING SAME

CROSS REFERENCE TO RELATED APPLICATIONS

This application is a divisional of application Ser. No. 14/896,215 filed Dec. 4, 2015, which is a National Stage of International Application No. PCT/JP2014/064995 filed Jun. 5, 2014, claiming priority based on Japanese Patent Application No. 2013-118893, filed Jun. 5, 2013, the contents of all of which are incorporated herein by reference in their entirety.

TECHNICAL FIELD

The present invention relates to a rare earth magnet and a method for manufacturing the same.

BACKGROUND ART

A rare earth magnet using a rare earth element is also called a permanent magnet and is used for a motor making up a hard disk or an MRI as well as for a driving motor of a hybrid vehicle, an electric vehicle, etc., The index indicative of the magnet performance of the rare earth magnet includes residual magnetization (residual flux density) and coercive force. Meanwhile, as the amount of heat generation grows due to the trend to a more compact motor and a higher current density, heat resistance is more increasingly required also of the rare earth magnet used therein, and how the coercive force of a magnet can be maintained in use at high temperatures is one of important research themes in this technical field. Considering an Nd—Fe—B magnet that is one of rare earth magnets often used in a vehicle driving motor, attempts are made to increase the coercive force, for example, by achieving refinement of a crystal grain, using an alloy of a composition having a large Nd amount, or adding a heavy rare earth element having a high coercivity performance, such as Dy and Tb.

As the rare earth element, there are not only a general sintered magnet in which the crystal grain constituting the structure is on a scale of approximately from 3 to 5 μm, but also a nanocrystalline magnet in which the crystal grain is refined to a nanoscale of 50 to 300 nm.

The microstructure of an Nd—Fe—B general rare earth magnet consists of an Nd-rich crystal grain and a grain boundary intervening between crystal grains. Since Nd constituting the crystal grain is an expensive rare earth element, how the amount of the element used can be reduced while ensuring the magnet performance is one of important development challenges in this technical field.

As the measure regarding the reduction in the amount of Nd used, it is conceivable to use a light rare earth element such as Ce and La or use an element such as Gd, Y, Sc, Sm and Lu.

However, as well as in the case of applying such an element in place of Nd, even when most of Nd is substituted by such an element, significant deterioration of the magnetic properties of the rare earth magnet is envisaged. Therefore, the amount of such an element used must be limited, and an effect of sufficiently reducing the material cost cannot be expected. Furthermore, when such an element having low magnetic properties is used, there is generally a very strong tendency that the use form thereof is limited to an isotropic form.

In the case where anisotropization of a rare earth magnet using the above-described light rare earth element or an element such as Gd and Y is attempted, the coercive force of the rare earth magnet decreases significantly, for example, in the working process such as hot plastic working, and the magnetic properties are inevitably deteriorated.

Here, Patent Document 1 discloses a magnetic material produced through a rapid solidification process and the subsequent heat annealing process, wherein the magnetic material has, by atomic percentage, the following composition: $(R_{1-a}R'_a)_uFe_{100-u-v-w-x-y}Co_vM_wT_xB_y$ (wherein R is Nd, Pr, didymium (a natural mixture of Nd and Pr, having a composition of $Nd_{0.75}Pr_{0.25}$), or a combination thereof, R' is La, Ce, Y, or a combination thereof, M is one or more of Zr, Nb, Ti, Cr, V, Mo, W and Hf, T is one or more of Al, Mn, Cu and Si, $0.01 \le a \le 0.8$, $7 \le u \le 13$, $0 \le v \le 20$, $0.01 \le w \le 1$, $0.1 \le x \le 5$, and $4 \le y \le 12$) and exhibits a residual magnetism (Br) value of about 6.5 kG to about 8.5 kG and an intrinsic coercive force of about 6.0 kOe to about 9.9 kOe.

While the magnetic material disclosed is a magnetic material where part of Nd is substituted by La or Ce, this is a compositional material for a rare earth-lean nano-composite magnet or a compositional material close thereto, and such a compositional material is composed of not an anisotropic but isotropic magnetic powder. Because, in the case of a compositional material for a nano-composite magnet or a compositional material close thereto, even when hot plastic working is performed in the plastic state with an attempt to form an oriented magnet, only a magnet having insufficient magnet performance can be formed.

In this way, the magnet material disclosed in Patent Document 1 may be an isotropic magnet material and is improper as a magnet material for the manufacture of an anisotropic rare earth magnet. Furthermore, Patent Document 1 is absolutely silent as to taking a measure for imparting anisotropy to such an isotropic magnet material.

RELATED ART

Patent Document

Patent Document 1: Kohyo (National Publication of Translated Version) No. 2007-524986

SUMMARY OF THE INVENTION

Problems to be Solved by the Invention

The present invention has been made by taking into account the problems above, and an object of the present invention is to provide a rare earth magnet ensuring excellent magnetic anisotropy while reducing the amount of a rare earth magnet such as Nd, and a manufacturing method thereof.

Means to Solve the Problems

In order to attain the above-described object, the rare earth magnet according to a first aspect comprises a crystal grain having an overall composition of $(R2_{(1-x)}R1_x)_yFe_{100-y-w-z-v}Co_wB_zTM_v$ (wherein R2 is at least one of Nd, Pr, Dy and Tb, R1 is an alloy of at least one or two or more of Ce, La, Gd, Y and Sc, TM is at least one of Ga, Al, Cu, Au, Ag, Zn, In and Mn, $0<x<1$, $y=12$ to 20, $z=5.6$ to 6.5, $w=0$ to 8, and $v=0$ to 2), wherein the average grain size of the crystal grain is 1,000 nm or less, the crystal grain consists of a core and an outer shell, the core has a composition of R1 that is richer than R2, and the outer shell has a composition of R2 that is richer than R1.

In order to attain the above-described object, the rare earth magnet according to a second aspect comprises a crystal grain having an overall composition of $(Nd_{(1-x)}Ce_x)_y Fe_{100-y-w-z-v}Co_wB_zTM_v$ (wherein TM is at least one of Ga, Al, Cu, Au, Ag, Zn, In and Mn, 0<x<1, y=12 to 20, z=5.6 to 6.5, w=0 to 8, and v=0 to 2), wherein the crystal grain consists of a core and an outer shell and has a composition of x in the core that is larger than x in the outer shell.

In the rare earth magnet of the present invention, the crystal grain thereof consists of a core and an outer sell and the core is richer in the light rare earth element such as Ce and La or in the element such as Gd and Y than in Nd, etc., so that the material cost can be greatly reduced, compared with a rare earth magnet composed of a crystal grain having an Nd-rich core. In this way, the core is in the state of that is rich in an inexpensive element with low magnetic properties, nevertheless, thanks to a configuration where an outer shell in the state of that is rich in Nd, etc., is present, magnetic decoupling between crystal grains is achieved while suppressing reduction in the magnetic properties, as a result, a rare earth magnet excellent in the magnetic anisotropy is formed.

Incidentally, the core of the crystal grain is a semi-hard phase having a relatively low coercive force because of a small amount of Nd, etc., whereas the outer shell of the crystal grain is a hard phase having a high coercive force due to a large amount of Nd, etc., and therefore, the crystal grain constituting the rare earth magnet can be the to have a composite structure of a semi-hard phase and a hard phase. Thus, the crystal grain has, as an outer shell, a hard phase with a high coercive force and in turn, magnetic decoupling between crystal grains is achieved, leading to enhancement of the magnetic properties.

Furthermore, in the rare earth magnet of the present invention, the average grain size of the crystal grain is adjusted to 1,000 nm or less, so that a given demagnetization resistance, i.e., a given coercive force, can be ensured. The reason therefor is as follows. That is, unlike a pure $Nd_2Fe_{14}B$ magnet (neodymium magnet), the crystal grain constituting the rare earth magnet of the present invention has a core in the state of that is rich in Ce, La, etc., with low magnetic properties. Here, the relationship between the average grain size of the crystal grain and the coercive force of the material generally has a tendency that as shown in FIG. 3, for example, in a relationship graph where the abscissa represents the average grain size (linear scale) and the ordinate represents the coercive force, the coercive force linearly decreases with an increase in the average grain size. Since the crystal grain constituting the rare earth magnet of the present invention is in the state of the core that is rich in an element with low magnetic properties as described above, the magnetic anisotropy is low and the demagnetization resistance is low, compared with a pure neodymium magnet. Therefore, if the average grain size is too large, the magnetic force is reduced by self-magnetization of the grain itself due to a grain size effect and magnetic domain reversal occurs. According to the present inventors, taking into consideration the low magnetic properties of the core in the crystal grain constituting the rare earth magnet of the present invention, it is specified that when the average grain size is 1,000 nm or less, magnetic domain reversal due to reduction in the magnetic force by self-magnetization of the grain itself does not occur and a rare earth magnet ensuring the magnetic properties is formed.

The conditions necessary to form a magnet without causing demagnetization of a semi-hard phase are described by using the Kronmuller formula. The Kronmuller formula can be represented by the following formula 1:

$$Hc=\alpha Ha-NMs \quad \text{(formula 1)}$$

wherein Hc: a coercive force, α: a factor to which decoupling property between crystal grain contributes, Ha: a crystal magnetic anisotropy (specific to the crystal grain material), N: a factor to which the grain size of the crystal grain contributes, and Ms: a saturation magnetization (specific to the crystal grain material).

When N (Neff) at α=1 is determined, the following formula is established:

$$N\text{eff}=(Ha-Hc)/Ms \quad \text{(formula 2)}$$

The relationship between Neff and the crystal grain size D, when experimentally determined on a rare earth magnet, is as shown in FIG. 4 and can be represented by the following formula 3:

$$N\text{eff}=0.25\ \text{Ln}(D)-0.475 \quad \text{(formula 3)}$$

The relationship between the required coercive force He and the crystal grain size D is obtained from formula 2 and formula 3 and can be represented by the following formula 4:

$$D\leq\exp(4(Ha-Hc)/Ms+1.7) \quad \text{(formula 4)}$$

According to the present inventors, it is specified that in formula 1 established as a premise for completing a magnet, Hc≥0 and for sufficiently ensuring the magnet performance, Hc≥13.

For example, when Ce is selected as the semi-hard phase and Hc=13 kOe (=about Ha/2), since Ha=26 kOe and Ms=12 kG, D≤417 nm is led and it is understood that the average grain size D is preferably about 500 nm or less. On the other hand, in the case of use for applications requiring He of about 10 kOe, D is about 1,133 nm with Hc=10 kOe and therefore, when the crystal grain is used in an average grain size D region satisfying D<1,133 nm, i.e., in the range of about 1,000 nm or less, magnetic domain reversal resulting from reduction in the magnetic force due to self-magnetization of the grain itself does not occur, and a rare earth magnet ensuring the magnetic properties is formed.

For these reasons, in the rare earth magnet of the present invention, the average grain size of the crystal grain thereof is specified to be 1,000 nm or less, preferably 500 nm.

According to the rare earth magnet of the present invention, the amount of an expensive element as a compositional component of the crystal grain, such as Nd, Pr, Dy and Tb, is reduced and instead, a relatively inexpensive Ce, La, etc., is applied, so that the material cost can be far lower than that of conventional rare earth magnets. Moreover, the crystal grain has a structure where an outer shell rich in Nd, Pr, Dy, Tb, etc., is present around a core rich in Ce, La, etc., and therefore, a rare earth magnet composed of a crystal grain with excellent magnetic anisotropy is obtained.

The present invention also provides a method for manufacturing a rare earth magnet, and the manufacturing method includes a first step of performing hot pressing by using a magnetic powder containing a crystal grain having a composition of $(R2_{(1-x)}R1_x)_yFe_{100-y-y-w-z-v}Co_wB_zTM_v$ (wherein R2 is at least one of Nd, Pr, Dy and Tb, R1 is an alloy of at least one or two or more of Ce, La, Gd, Y and Sc, TM is at least one of Ga, Al, Cu, Au, Ag, Zn, In and Mn, 0<x≤1, y=12 to 20, z=5.6 to 6.5, w=0 to 8, and v=0 to 2) to produce a rare earth magnet precursor, and a second step of diffusing and impregnating a modifying metal composed of an R2 element or an R2-TM alloy into the rare earth magnet precursor to manufacture a rare earth magnet provided with a crystal grain having an average grain size of 1,000 nm or less and consisting of a core and an outer shell, the core having a composition of R1 that is richer than R2, and the outer shell having a composition of R2 that is richer than R1.

In the manufacturing method of the present invention, a rare earth magnet precursor is produced in the first step by using a crystal grain in which part of Nd, etc., is substituted by a light rare earth element, etc., and thereafter, a modifying metal composed of an R2 element or an R2-TM alloy is diffused and impregnated into the rare earth magnet precursor in the second step, whereby a rare earth magnet excellent in the magnetic anisotropy and composed of a crystal grain consisting of a core in the state of that is rich in a light rare earth element, etc., and an outer shell in the state of that is rich in Nd, etc., can be manufactured. In the method, the first step may be a step where hot press working is performed to produce a compact and this compact is subjected to hot plastic working to produce a rare earth magnet precursor.

In the first step of manufacturing a rare earth magnet precursor, the precursor can be produced by various methods, and specific examples thereof include four production methods.

A first production method is a method where a magnetic powder pulverized to about 10 μm or less is subjected to magnetic field orientation and then to liquid phase sintering to produce an anisotropic rare earth magnet precursor. A second production method is a method where an isotropic magnetic powder of a nanocrystalline structure is produced by a liquid quenching method and the powder is subjected to hot press working to produce an isotropic rare earth magnet precursor. A third production method is a method where after the hot press working in the second production method, hot plastic working is applied to produce an anisotropic rare earth magnet precursor. A fourth production method is a method where an isotropic or anisotropic magnetic powder prepared by an HDDR method (Hydrogenation Decomposition Desorption Recombination) is subjected to hot press working to produce an isotropic or anisotropic rare earth magnet precursor.

In any of these methods, the crystal grain constituting the rare earth magnet precursor produced in the first step is a crystal grain containing Nd, etc., in a small amount and having low magnetic properties (composed of only the above-described semi-hard phase). In order to form an outer shell working out to a hard phase on the crystal grain above, in the second step, a modifying metal composed of an R2 element or an R2-TM alloy (R2 element: at least one of Nd, Pr, Dy and Tb, and TM: at least one of Ga, Al, Cu, Au, Ag, Zn, In and Mn) is diffused and impregnated into the rare earth magnet precursor. The method for diffusing and impregnating the modifying metal also includes various methods, and specific examples thereof include three methods.

A first method is a method of applying a vapor phase method where an R2 element is vaporized in a vacuum at around 850° C. to penetrate into the grain boundary of the rare earth magnet precursor. A second method is a method of applying a liquid phase method where a melt of an R2-TM alloy with a low melting point is liquid-phase impregnated into the grain boundary of the rare earth magnet precursor. A third method is a method of applying a solid phase method where an R2 element, an R2-TM alloy, or a solid of its compound with oxygen, fluorine, etc., is brought into contact with the rare earth magnet precursor and heated at approximately from 500 to 900° C. to cause an exchange reaction of an R1 solid solution remaining in the grain boundary between crystal grains with the R2 element and thereby diffuse and impregnate a modifying metal through the grain boundary.

Another embodiment of the method for manufacturing a rare earth magnet of the present invention includes a step of heating an Re-M alloy (wherein Re is a rare earth element and M is an element capable of reducing the melting point of the rare earth element by that is alloyed) at a temperature not lower than the melting point thereof to melt the alloy, and a step of bringing the molten Re-M alloy into contact with a magnetic particle containing a transition metal element to diffuse Re in the Re-M alloy into the magnetic particle. Here, Re is preferably at least either one of Nd and Sm, the melting point of the Re-M alloy is preferably 800° C. or less, M is preferably at least one of Cu, Fe, Al and Ga, and the transition metal is preferably at least one of Fe, Co and Ni.

In the manufacturing method of the present invention, the average grain size of the crystal grain in the rare earth magnet manufactured is also adjusted to 1,000 nm or less and is preferably adjusted to an average grain size of 500 nm or less.

Effects of the Invention

As understood from the description in the foregoing pages, according to the rare earth magnet of the present invention and the manufacturing method thereof, the amount of an expensive element as a compositional component of the crystal grain, such as Nd, Pr, Dy and Tb, is reduced and instead, a relatively inexpensive Ce, La, etc., is applied, so that in addition to reduction in the material cost, by virtue of the crystal grain having a structure where an outer shell rich in Nd, Pr, Dy, Tb, etc., is present around a core rich in Ce, La, etc., magnetic decoupling between crystal grains can be achieved and a rare earth magnet composed of a crystal grain with excellent magnetic anisotropy can be provided.

MODE FOR CARRYING OUT THE INVENTION

Figure 1:
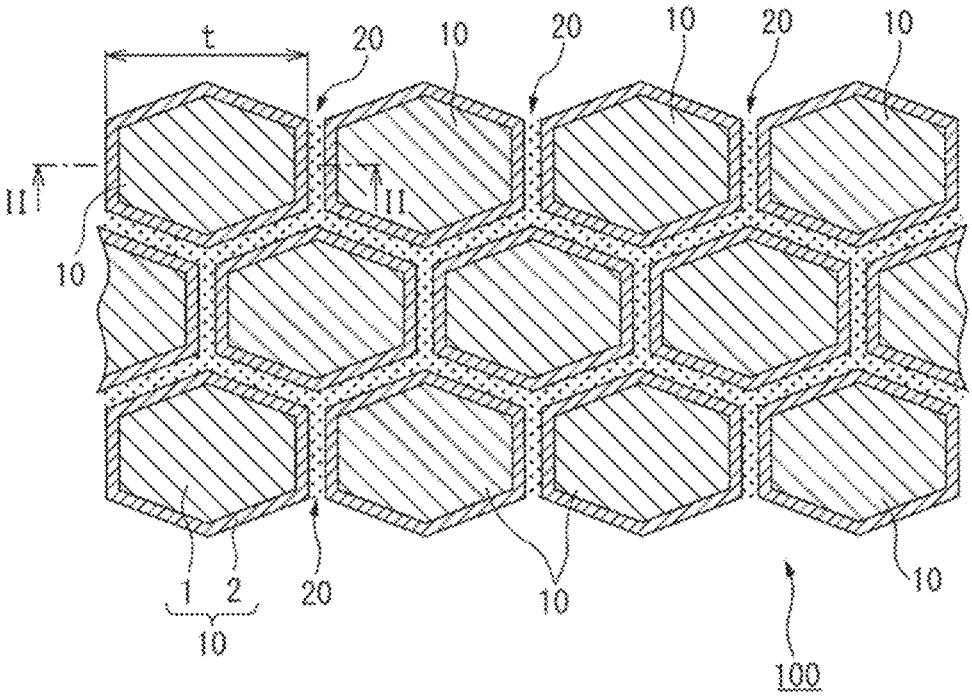
FIG. 1 A schematic view for explaining the microstructure of the rare earth magnet of the present invention.

The mode for carrying out the rare earth magnet of the present invention and the manufacturing method thereof are described below by referring to the drawings.

(Rare Earth Magnet)

Figure 2:
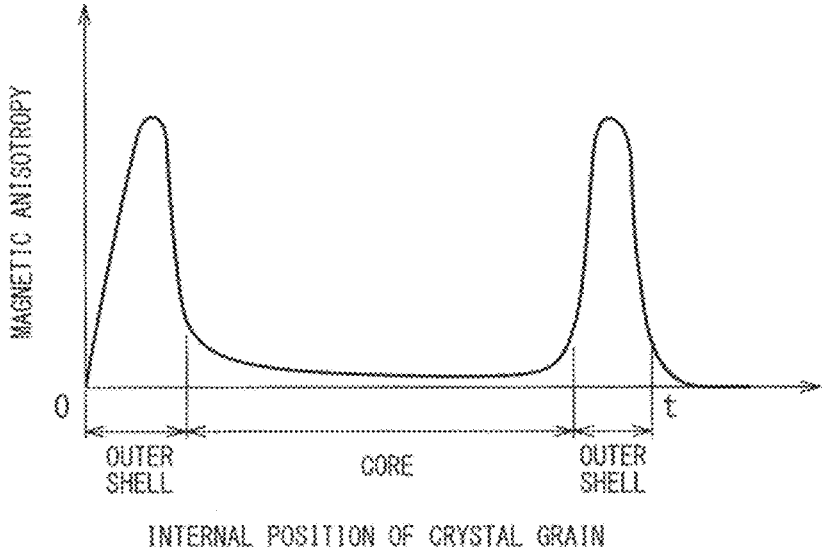
FIG. 2 A view for explaining the magnetic anisotropy at each position on the line II-II in FIG. 1.
Figure 3:
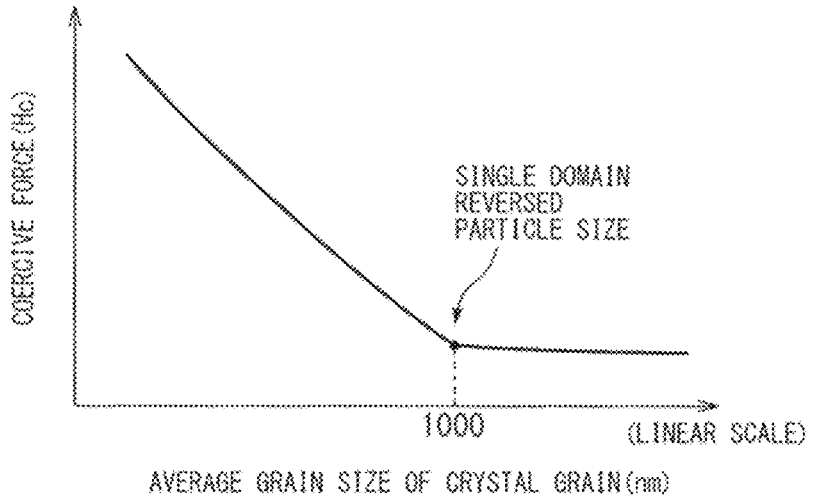
FIG. 3 A view for explaining the relationship between the average grain size of the crystal grain and the coercive force.
Figure 4:
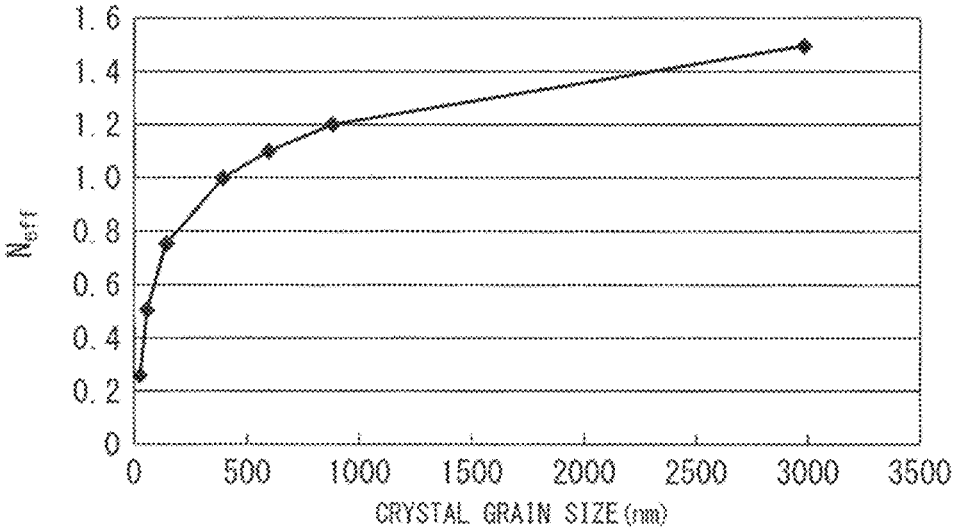
FIG. 4 A view for explaining the relationship between the average grain size of the crystal grain and the factor (Neff) to which the grain size of the crystal grain contributes.

FIG. 1 is a schematic view for explaining the microstructure of the rare earth magnet of the present invention, and FIG. 2 is a view for explaining the magnetic anisotropy at each position on the line II-II in FIG. 1. The rare earth magnet 100 shown has a microstructure where a large number of crystal grains 10 are juxtaposed through a grain boundary 20. The crystal grain 10 illustrated has a hexagonal cross-sectional shape but may have various cross-sectional shapes such as quadrilateral (rectangular, rhombic) or elliptic.

The crystal grain 10 has a so-called core-shell structure consisting of a core 1 and an outer shell 2.

The crystal grain 10 has an overall composition of $(R2_{(1-x)}R1_x)_yFe_{100-y-w-z-v}Co_wB_zTM_v$ (wherein R2 is at least one of Nd, Pr, Dy and Tb, R1 is an alloy of at least one or two or more of Ce, La, Gd, Y and Sc, TM is at least one of Ga, Al, Cu, Au, Ag, Zn, In and Mn, $0<x<1$, y=12 to 20, z=5.6 to 6.5, w=0 to 8, and v=0 to 2), and this crystal grain consists of a core and an outer shell, where the core has a composition of R1 that is richer than R2 and the outer shell have a composition of R2 that is richer than R1.

Here, the crystal grain preferably has a composition where R2 is Nd, R1 is Ce, and x in the core is larger than x in the outer shell.

The core 1 is in the state where R1 is richer than R2 or x in the core is larger than x in the outer shell, more specifically, for example, an element rendering the material cost far lower than Nd, etc., such as Ce or La, is richer than Nd, etc., so that the material cost can be greatly reduced, compared with a rare earth magnet composed of a magnetic material having an Nd-rich core, i.e., a general $Nd_2Fe_{14}B$ magnet (neodymium). The "in the core 1, R1 is richer than R2" as used herein encompasses a case where the concentrations of R1 and R2 are the same.

However, since the core 1 constituting the crystal grain 10 is in the state of that is rich in Ce, La, etc., the magnetic properties are inevitably reduced, compared with a general $Nd_2Fe_{14}B$ magnet.

In order to suppress this reduction in the magnetic properties, the crystal grain 10 illustrated has, around the core 1, an outer shell 2 in which R2 is richer than R1, i.e., an outer shell 2 in which Nd, etc., is richer than Ce, La, etc., and the magnetic decoupling between adjacent crystal grains 10 can be thereby achieved, providing for magnetic anisotropy, as a result, reduction in the magnetic properties such as coercive force and residual magnetization is suppressed.

This is easily understood from FIG. 2 that is a view illustrating the magnetic anisotropy for each site of the crystal grain 10. As illustrated in the Figure, the core 1 is a region rich in Ce, La, etc., having low magnetic properties and therefore, also has low magnetic anisotropy, whereas the outer shell 2 is a region rich in Nd, etc., and therefore, has high magnetic anisotropy.

In this way, the crystal grain 10 is configured to have an outer shell 2 rich in Nd, etc., while greatly reducing the amount of Nd, etc., by forming a core 1 in the state of that is rich in an inexpensive element, and be thereby prevented from reduction in the magnetic properties. More specifically, the coercive force is enhanced when the magnetic anisotropy of the outer shell is higher than the magnetic anisotropy of the core, and therefore, it is considered that the rare earth magnet of the present invention, by virtue of having a core-shell structure, is insusceptible to an external magnetic field and is less likely to allow a magnetization reversal on the periphery of a crystal, as a result, a magnetization reversal of the entire magnet phase is suppressed. Accordingly, the rare earth magnet 100 composed of such a crystal grain 10 comes to have magnetic anisotropy and excellent magnetic properties while achieving a reduction in the material cost of the rare earth magnet and a consequent reduction in the production cost of the rare earth magnet.

In addition, in the rare earth magnet of a core-shell structure of the present invention, the coercive force at a temperature of 160° C. or less is enhanced, compared to conventional magnets in which a boundary is not present between the core and the outer shell and magnet phases $Nd_2Fe_{14}B$ and $Ce_2Fe_{14}B$ are mixed. This is considered to be achieved because while the temperature characteristic is enhanced due to $Ce_2Fe_{14}B$ in the core, the magnetization is less likely to reverse due to $Nd_2Fe_{14}B$ in the outer shell and the ratio of decrease in the coercive force at a high temperature is thereby suppressed.

The average grain size of the crystal grain 10 illustrated in FIG. 1 is 1,000 nm or less, preferably 500 nm or less.

The "average grain size" as used herein indicates an average value of longitudinal lengths t of crystal grains 10, for example, shown in FIG. 1 (although the cross-section is not circular, the length is included in the "grain size"). For example, a given region is specified in an SEM image, a TEM image, etc., of the rare earth magnet 100, and the average value of grain sizes t of respective crystal grains present in the given region is calculated, whereby the "average grain size" is determined. In the case where the cross-sectional shape of the crystal grain is elliptic, the long axis may be taken as the grain size, and in the case of a quadrilateral shape, the diagonal length may be taken as the grain size. The above-exemplified method for calculating the average grain size is persistently an example.

The reason why the average grain size of the crystal grain 10 is set to 1,000 nm or less, preferably 500 nm or less, is as described above.

In the rare earth magnet of the present invention, the core of the crystal grain is a central portion of the crystal grain, and the outer shell is a surface portion of the crystal grain.

(Method for Manufacturing Rare Earth Magnet)

The method for manufacturing the rare earth magnet 100 shown in FIG. 1 is described below.

First, a magnetic power containing a crystal grain having a composition of $(R2_{(1-x)}R1_x)_yFe_{100-y-w-z-v}Co_wB_zTM_v$ (wherein R2 is at least one of Nd, Pr, Dy and Tb, R1 is an alloy of at least one or two or more of Ce, La, Gd, Y and Sc, TM is at least one of Ga, Al, Cu, Au, Ag, Zn, In and Mn, $0<x\leq1$, y=12 to 20, z=5.6 to 6.5, w=0 to 8, and v=0 to 2) is produced.

As the method for producing the magnetic powder, for example, a method of producing an isotropic magnetic powder of a nanocrystalline structure by a liquid quenching method, or a method of producing an isotropic or anisotropic magnetic powder by an HDDR method, can be applied.

Describing the method by a liquid quenching method, for example, an alloy ingot is high-frequency melted by a melt spinning method using a single roll in a furnace (not shown) in an Ar gas atmosphere at a pressure reduced to 50 kPa or less, and a molten metal having the composition of the core 1 is sprayed on a copper roll to prepare a quenched thin strip B (quenched ribbon), which is then coarsely pulverized, whereby the magnetic powder can be produced.

A magnetic powder pulverized, for example, to about 10 μm or less is subjected to magnetic field orientation and then to liquid phase sintering to produce an anisotropic rare earth magnet precursor. Alternatively, an isotropic magnetic powder of a nanocrystalline structure produced by a liquid quenching method is subjected to hot press working to produce an isotropic rare earth magnet precursor. Alternatively, an isotropic magnetic powder of a nanocrystalline structure is subjected to hot press working and then to hot plastic working to produce an anisotropic rare earth magnet precursor. Alternatively, an isotropic or anisotropic magnetic powder prepared by an HDDR method is subjected to hot press working to produce an isotropic or anisotropic rare earth magnet precursor.

An isotropic or anisotropic rare earth magnet precursor is produced by the method above (up to this is the first step of the manufacturing method).

The crystal grain constituting the rare earth magnet precursor produced in the first step is a crystal grain containing Nd, etc., in a small amount and having low magnetic properties (composed of only the semi-hard phase described above). In order to form an outer shell working out to a hard phase on the crystal grain above, a modifying metal composed of an R2 element or an R2-TM alloy (R2 element: at least one of Nd, Pr, Dy and Tb, and TM: Ga or an element obtained by substituting part of Ga with at least one of Al, Cu, Au, Ag, Zn, In, Mn and Fe) is diffused and impregnated into the rare earth magnet precursor (the second step of the manufacturing method).

For example, a vapor phase method where an R2 element is vaporized in a vacuum at around 850° C. to penetrate into the grain boundary of the rare earth magnet precursor is applied. Alternatively, a liquid phase method where a melt of an R2-TM alloy with a low melting point is liquid-phase impregnated into the grain boundary of the rare earth magnet precursor is applied. Alternatively, a solid phase method where an R2 element, an R2-TM alloy, or a solid of its compound with oxygen, fluorine, etc., is brought into contact with the rare earth magnet precursor and heated at approximately from 500 to 900° C. to cause an exchange reaction of an R1 solid solution remaining in the grain boundary between crystal grains with the R2 element and thereby diffuse and impregnate a modifying metal through the grain boundary is applied.

Here, a heavy rare earth element such as Dy and Tb may be used as the R2 element or R2-TM alloy, but it is preferable to use either Nd or Pr as the R2 element or use a transition metal element or typical metal element as the TM element of the R2-TM alloy, without using a heavy rare earth element. Any one of Cu, Mn, In, Zn, Al, Ag, Ga and Fe is preferably used. Specific examples of the R2-TM alloy include an Nd—Cu alloy (eutectic point: 520° C.), a Pr—Cu alloy (eutectic point: 480° C.), an Nd—Pr—Cu alloy, an Nd—Al alloy (eutectic point: 650° C.), and an Nd—Pr—Al alloy, and in all of these alloys, the eutectic point is a very low temperature of about 650° C. or less. Incidentally, even in the case of using a heavy rare earth element or an alloy thereof as the modifying alloy, an alloy having a eutectic point of about 900° C. or less should be used.

In the case of not using a heavy rare earth element for the R2 element or R2-TM alloy, the material cost can be further reduced. In addition, since an R2-TM alloy having a low eutectic point as described above is used and its diffusion and impregnation at a low temperature is achieved, the manufacturing method of the present invention is suitable for a nanocrystalline magnet (crystal grain size is approximately from 50 to 300 nm) that encounters a problem of coarsening of the crystal grain when placed, for example, in a high-temperature atmosphere of about 800° C. or more.

In another embodiment of the method for manufacturing a magnet of the present invention, an Re-M alloy (wherein Re is a rare earth element and M is an element capable of reducing the melting point of the rare earth element by that is alloyed) is heated at a temperature not lower than the melting point thereof to melt the alloy (first step). As the alloy containing a rare earth element, the above-described R2-TM alloy may be used, and an alloy of a difficultly reducible metal element, i.e., a metal having a redox potential of −1 eV or less, and an element capable of reducing the melting point of the metal, is preferred. Re is preferably at least either one of Nd and Sm, M is at least one of Cu, Fe, Al and Ga, and Re-M is mot preferably SmCu or SmFe. The melting point of the Re-M alloy is preferably 800° C. or less. In order to have a melting point of 800° C. or less, in the case of Nd—Cu, the Nd content is set to be from 40 to 90%; in the case of Nd—Fe, the Nd content is set to be from 60 to 80%; and in the case of Sm—Cu, the Sm content is set to be from 40 to 90%.

Next, the molten Re-M alloy is brought into contact with a magnetic particle containing a transition metal element to diffuse Re in the Re-M alloy into the magnetic particle (second step). The transition metal element is preferably at least one of Fe, Co and Ni.

Figure 5:
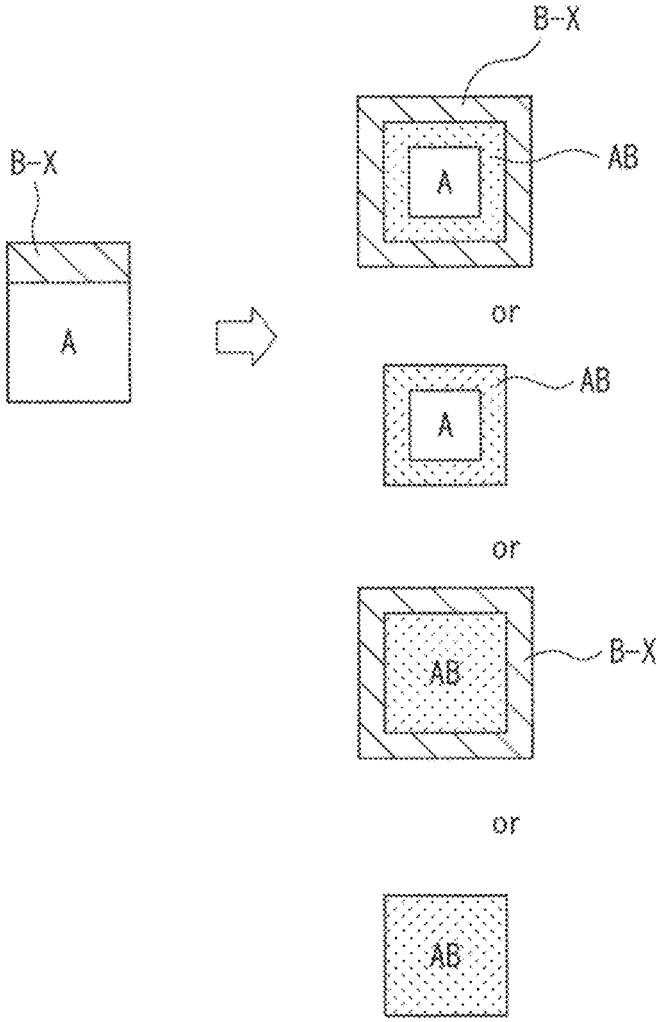
FIG. 5 A diagrammatic view for explaining the method of the present invention.
Figure 6:
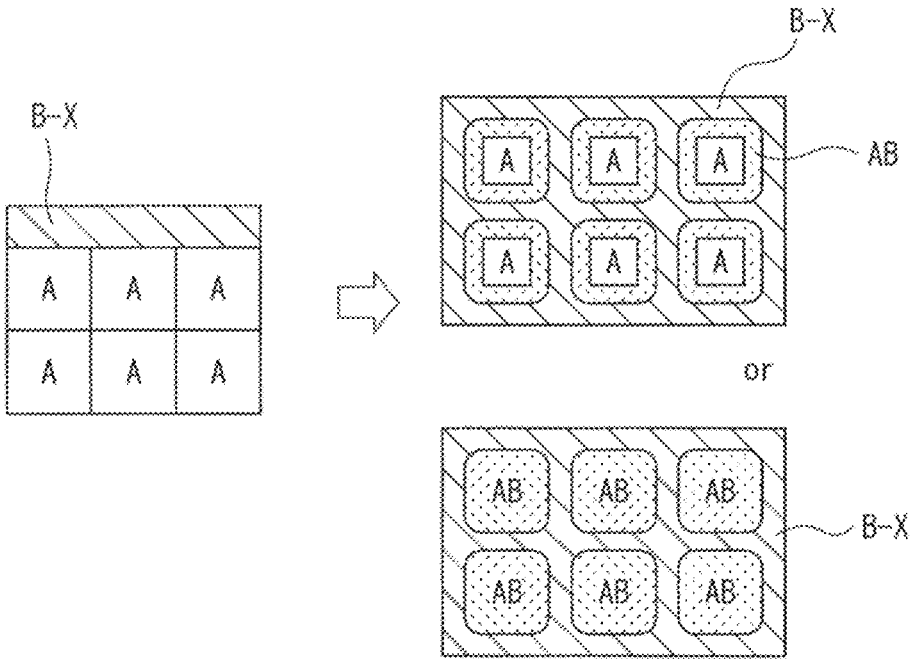
FIG. 6 A diagrammatic view for explaining the method of the present invention.

This method is described by referring to the drawings. As shown in FIG. 5, a liquid phase that is a melt of a B—X alloy (Re-M alloy) is brought into contact with particle A (magnetic particle containing a transition metal element) prepared by pulverization or chemical synthesis, as a result, element substitution occurs in particle A, whereby four kinds of multi-phase structures shown can be produced. In addition, as shown in FIG. 6, a liquid phase that is a melt of a B—X alloy (Re-M alloy) is brought into contact with an aggregate structure that is a green compact or sintered body of particle A (magnetic particle containing a transition metal element) prepared by pulverization or chemical synthesis, whereby two kinds of multi-phase structures shown can be produced.

Control of a difficulty reducible element-containing nano-level structure that is difficult to synthesize by a chemical technique, i.e., nanoparticle formation or formation of a core-shell structure, has been conventionally performed by rapid cooling/solidification or pulverization, but there is a problem in the anisotropization or oxidizability. Among others, an alloy containing a rare earth magnetic material is highly active and in order to impart high magnetic properties, nanostructure formation is supposed to be necessary, but a production method capable of providing an ideal structure has not been heretofore known.

The difficultly reducible element is readily oxidized and since the surface area is increased at the time of nanoparticle formation by pulverization, oxidation proceeds, leading to breaking from the originally targeted structure. In the rapid solidification method, when anisotropization by unidirectional solidification is attempted, the particle is coarsened to few micro meters or more. Nanostructure formation may be achieved by increasing the rapid cooling rate, but anisotropization cannot be effected.

On the other hand, according to the method of the present invention, as to an alloy containing a difficultly reducible element, a particle having a core-shell structure can be easily and simply produced, structure control at the nanostructure level becomes possible, and in the case of a magnetic material, a structure not more than the single domain particle size can be produced, leading to enhancement of the coercive force.

EXAMPLES

Example 1

An alloy having a composition of $(Nd_{(1-x)}Ce_x)_y Fe_{100-y-w-z-v}Co_wB_zGa_v$ (x=1, y=13.5, z=5.8, w=4, and v=0.5) was nanocrystallized by liquid quenching (amorphous may be heat-treated). The conditions for quenching conducted here are a molten metal temperature of 1,450° C., an inert atmosphere (reduced-pressure Ar atmosphere) and a peripheral velocity of 20 to 40 m/s. The resulting ribbon having a nanocrystalline structure was packed in a die and subjected to pressurization/heating to produce a compact. The conditions for molding conducted here are a molding pressure of 200 MPa, a temperature of 650° C., and a holding time of 180 s. The obtained compact was subjected to hot plastic working (strong working) to form an oriented nanocrystalline structure. The conditions for strong working conducted here are a working temperature of 750° C., and a strain rate of 0.1 to 10/s, and the working method is swaging. The rare earth magnet precursor (core) produced by the swaging work is $Ce_2Fe_{14}B$ and is in a semi-hard state lower in the coercive force than $Nd_2Fe_{14}B$. Then a low-melting-point alloy of $Nd_{70}Cu_{30}$ was brought into contact with the rare earth magnet precursor in the semi-hard state and heat-treated at a temperature high enough to melt the alloy. The conditions for heat treatment conducted here are a heat treatment temperature of 700° C., a treatment time of 165 to 360 min, and a contact amount of alloy of 10 wt % (relative to the rare earth magnet precursor). Here, the $Nd_{70}Cu_{30}$ alloy was produced by weighing Nd (produced by Kojundo Chemical Laboratory Co., Ltd.) and Cu (produced by Kojundo Chemical Laboratory Co., Ltd.), arc melting these elements, and liquid-quenching the melt.

Figure 7:
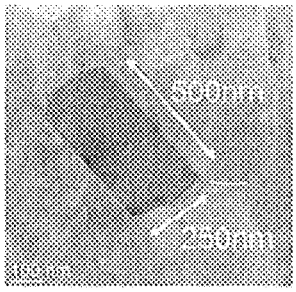
FIG. 7 A view showing the SEM observation results in Example 1.
Figure 8:
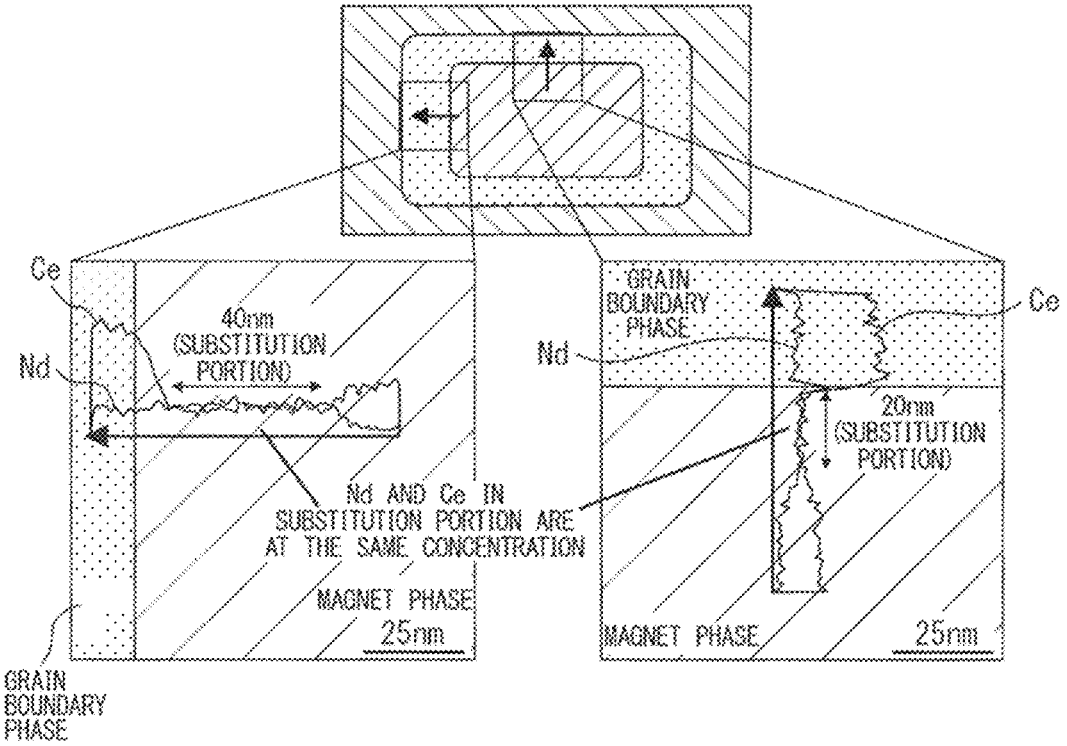
FIG. 8 A view showing the EDX analysis results in Example 1.
Figure 9:
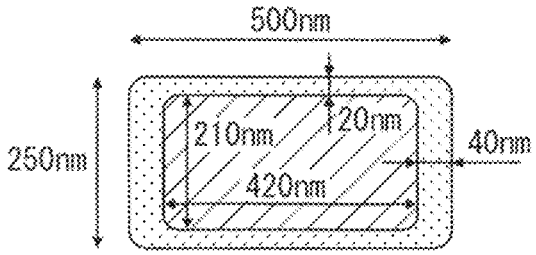
FIG. 9 A schematic view illustrating the configuration of the grain obtained in Example 1.

Through these steps, a core-shell type magnet having a structure where the core is a $Ce_2Fe_{14}B$ phase and the outer shell is a $(Nd_{0.5}Ce_{0.5})_2Fe_{14}B$ phase, and having an overall composition of $(Nd_{0.2}Ce_{0.8})_2Fe_{14}B$ was obtained. Here, although Co and Ga are contained in the starting alloy, these Co and Ga are not contained in the core and outer shell of the obtained magnet, because Co and Ga are actually contained in the core and out shell but since their contents are very small, these are ignored. The same applies to Examples 2 and 3 and Comparative Examples 1 to 3 below. Part of the thus-obtained magnet was sampled by FIB imaging, and a grain having an average grain size (250×500 nm) was extracted. FIG. 7 shows an SEM image of this grain. This grain was subjected to TEM-EDX line analysis to obtain the results shown in FIG. 8, and from these results, the grain was found to have the core 1 and outer sell 2 dimensions shown in FIG. 9. In addition, in this grain, the volume fraction of the core was 60.0%, and the volume fraction of the outer shell was 40.0%. Furthermore, the Nd concentration (Nd/(Nd+Ce)) was measured by TEM-EDX line analysis, as a result, the Nd concentration in the outer shell was 50.0%, and the Nd concentration in the entirety was 20.0%.

Example 2

A core-shell type magnet was obtained in the same manner as in Example 1 except that the contact amount of $Nd_{70}Cu_{30}$ alloy was changed to 20 wt %. The measurement results of volume fraction and Nd concentration are shown below.

Overall composition: $(Nd_{0.31}Ce_{0.69})_2Fe_{14}B$

Core: $Ce_2Fe_{14}B$, 53.6%

Outer shell: $(Nd_{0.669}Ce_{0.331})_2Fe_{14}B$, 46.4%

Nd Concentration in outer shell: 66.9%

Nd Concentration in the entirety: 31.0%

Example 3

A core-shell type magnet was obtained in the same manner as in Example 1 except that the contact amount of $Nd_{70}Cu_{30}$ alloy was changed to 40 wt %. The measurement results of volume fraction and Nd concentration are shown below.

Overall composition: $(Nd_{0.337}Ce_{0.663})_2Fe_{14}B$

Core: $Ce_2Fe_{14}B$, 53.5%

Outer shell: $(Nd_{0.726}Ce_{0.274})_2Fe_{14}B$, 46.5%

Nd Concentration in outer shell: 72.6%

Nd Concentration in the entirety: 33.7%

Comparative Example 1

An alloy where in the formula of Example 1, x=0.75 ($(Nd_{0.25}Ce_{0.75})_{13.5}Fe_{76.2}Co_4B_{5.8}Ga_{0.5}$), was used as the starting material and after production of a magnet, by not contacting $Nd_{70}Cu_{30}$ therewith, a magnet (strongly worked body, $(Nd_{0.25}Ce_{0.75})_2Fe_{14}B$) in which a boundary is not present between the core and the outer shell and magnet phases $Nd_2Fe_{14}B$ and $Ce_2Fe_{14}B$ are mixed, was manufactured.

Comparative Example 2

An alloy where in the formula of Example 1, x=0.5 ($(Nd_{0.5}Ce_{0.5})_{13.5}Fe_{76.2}Co_4B_{5.8}Ga_{0.5}$), was used as the starting material and after production of a magnet, by not contacting $Nd_{70}Cu_{30}$ therewith, a magnet (strongly worked body, $(Nd_{0.5}Ce_{0.5})_2Fe_{14}B$) in which a boundary is not present between the core and the outer shell and magnet phases $Nd_2Fe_{14}B$ and $Ce_2Fe_{14}B$ are mixed, was manufactured.

Comparative Example 3

An alloy where in the formula of Example 1, x=0.25 ($(Nd_{0.75}Ce_{0.25})_{13.5}Fe_{76.2}Co_4B_{5.8}Ga_{0.5}$), was used as the starting material and after production of a magnet, by not contacting $Nd_{70}Cu_{30}$ therewith, a magnet (strongly worked body, $(Nd_{0.75}Ce_{0.25})_2Fe_{14}B$) in which a boundary is not present between the core and the outer shell and magnet phases $Nd_2Fe_{14}B$ and $Ce_2Fe_{14}B$ are mixed, was manufactured.

Comparative Example 4

An alloy where in the formula of Example 1, x=1 ($Ce_{13.5}Fe_{76.2}Co_4B_{5.8}Ga_{0.5}$), was used as the starting material and after production of a magnet, by not contacting $Nd_{70}Cu_{30}$ therewith, a magnet (strongly worked body, ($Ce_{13.5}Fe_{76.2}Co_4B_{5.8}Ga_{0.5}$) in which a boundary is not present between the core and the outer shell, was manufactured.

Comparative Example 5

An alloy where in the formula of Example 1, x=0 ($Nd_{13.5}Fe_{76.2}Co_4B_{5.8}Ga_{0.5}$), was used as the starting material and after production of a magnet, by not contacting $Nd_{70}Cu_{30}$ therewith, a magnet (strongly worked body, ($Nd_{13.5}Fe_{76.2}Co_4B_{5.8}Ga_{0.5}$) in which a boundary is not present between the core and the outer shell, was manufactured.

With respect to the obtained magnets, after pulse magnetization of 10 T, the coercive force was measured at room temperature by VSM (Lake Shore). Subsequently, the hysteresis curve was measured at respective temperatures (room temperature, 60, 80, 100, 140, 160, 180 and 200° C.) ranging from room temperature to 200° C., and the coercive force was determined. The results at ordinary temperature are shown in Table 1 below.

TABLE 1

| | | Nd Concentration in Core (%) | Nd Concentration in Outer shell (%) | Nd Concentration in Entirety (%) | Coercive Force (kOe) |
|---|---|---|---|---|---|
| Core-shell type | Example 1 | 0 | 50 | 20 | 5.1 |
| | Example 2 | 0 | 66.9 | 31 | 7.5 |
| | Example 3 | 0 | 72.6 | 33.7 | 8.5 |
| Conventional technique type | Comparative Example 1 | — | — | 25 | 1.3 |
| | Comparative Example 2 | — | — | 50 | 9.6 |
| | Comparative Example 3 | — | — | 75 | 14.4 |
| | Comparative Example 4 | — | — | 0 | 0.3 |
| | Comparative Example 5 | — | — | 100 | 17 |

Figure 10:
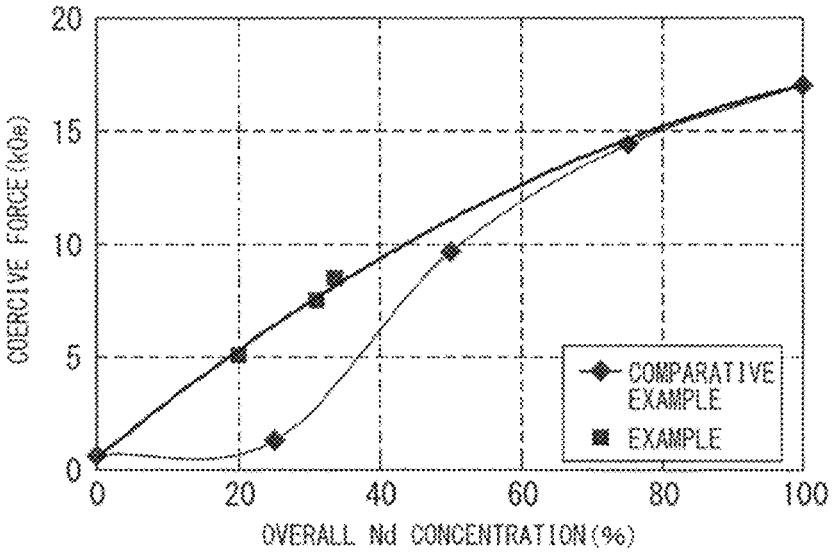
FIG. 10 A graph illustrating the relationship between the Nd concentration and the coercive force in Examples 1 to 3 and Comparative Examples 1 to 3.
Figure 11:
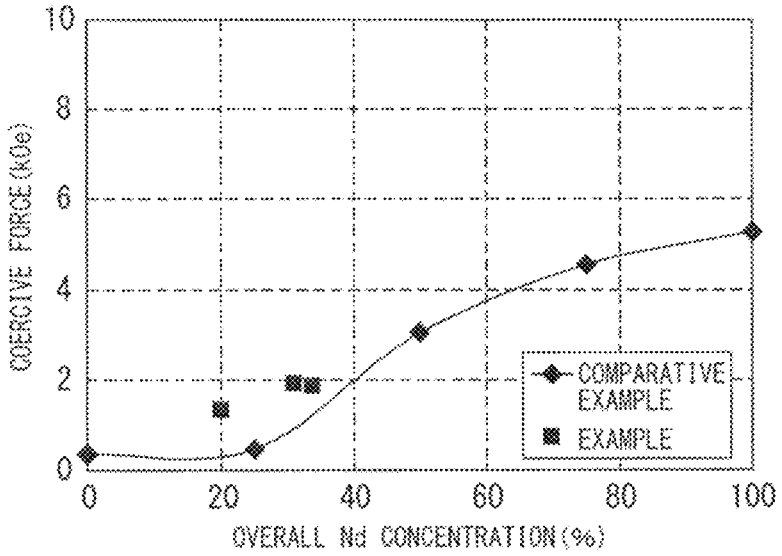
FIG. 11 A graph illustrating the relationship between the Nd concentration and the coercive force in Examples 1 to 3 and Comparative Examples 1 to 3.

FIG. 10 shows the results of Table 1. From these results, it was confirmed that in the magnets having a core-shell structure of Examples 1 to 3, the coercive force at ordinary temperature is enhanced, compared with the magnets in which $Nd_2Fe_{14}B$ and $Ce_2Fe_{14}B$ are mixed (Comparative Examples 1 to 3). In addition, FIG. 11 shows the results at 160° C. It was confirmed that in the magnets having a core-shell structure of Examples 1 to 3, the coercive force is enhanced in the range of from ordinary temperature to 160° C., compared with the magnets in which $Nd_2Fe_{14}B$ and $Ce_2Fe_{14}B$ are mixed (Comparative Examples 1 to 3).

Figure 12:
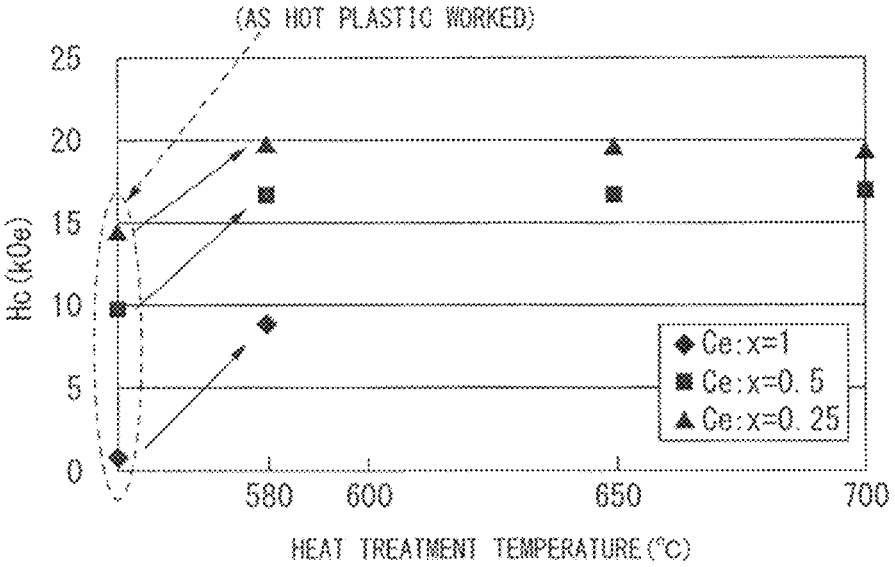
FIG. 12 A view showing the experiment results for verifying respective coercivity performances of the rare earth magnet manufactured by a manufacturing method not including a second step of diffusing and impregnating a modifying metal and the rare earth magnet manufactured by the manufacturing method of the present invention.

Similarly to Examples and Comparative Examples above, the coercive force was measured on each of rare earth magnets manufactured by using, as the starting material, respective alloys where in the formula of Example 1, x=1, 0.5 and 0.25, and performing only hot plastic working without diffusing and impregnating a modifying metal (corresponding to Comparative Examples 4, 2 and 3), and three kinds of rare earth magnets manufactured by setting the heat treatment temperature at the time of diffusion and impregnation of $Nd_{70}Cu_{30}$ to 580, 650 and 700° C., and the results are shown in Table 2 below and FIG. 12. Here, although Co and Ga are contained in the starting alloy, these Co and Ga are not contained in the core and outer shell of the obtained magnets, because Co and Ga are actually contained in the core and out shell but since their contents are very small, these are ignored.

TABLE 2

| x | Composition of Starting Raw Material | Impregnation Temperature | Impregnation Solution | Composition of Outer Shell | Composition of Core | Overall Composition | Coercive Force at Ordinary Temperature (kOe) |
|---|---|---|---|---|---|---|---|
| 1 | $Ce_{13.5}Fe_{76.2}Co_4B_{5.8}Ga_{0.5}$ | 580 | $Nd_{70}Cu_{30}$ | $(Nd_{0.5}Ce_{0.5})_2Fe_{14}B$ | $Ce_2Fe_{14}B$ | $Ce_{13.5}Fe_{76.2}Co_4B_{5.8}Ga_{0.5}$ | 1.1 |
| 1 | $Ce_{13.5}Fe_{76.2}Co_4B_{5.8}Ga_{0.5}$ | — | — | — | — | $Ce_{13.5}Fe_{76.2}Co_4B_{5.8}Ga_{0.5}$ | 0.3 |
| 0.5 | $(Nd_{0.5}Ce_{0.5})_{13.5}Fe_{76.2}Co_4B_{5.8}Ga_{0.5}$ | 700 | $Nd_{70}Cu_{30}$ | $(Nd_{0.83}Ce_{0.17})_2Fe_{14}B$ | $(Nd_{0.5}Ce_{0.5})_2Fe_{14}B$ | $(Nd_{0.566}Ce_{0.434})_2Fe_{14}B$ | 16.8 |
| 0.5 | $(Nd_{0.5}Ce_{0.5})_{13.5}Fe_{76.2}Co_4B_{5.8}Ga_{0.5}$ | 650 | $Nd_{70}Cu_{30}$ | $(Nd_{0.83}Ce_{0.17})_2Fe_{14}B$ | $(Nd_{0.5}Ce_{0.5})_2Fe_{14}B$ | $(Nd_{0.566}Ce_{0.434})_2Fe_{14}B$ | 16.8 |
| 0.5 | $(Nd_{0.5}Ce_{0.5})_{13.5}Fe_{76.2}Co_4B_{5.8}Ga_{0.5}$ | 580 | $Nd_{70}Cu_{30}$ | $(Nd_{0.83}Ce_{0.17})_2Fe_{14}B$ | $(Nd_{0.5}Ce_{0.5})_2Fe_{14}B$ | $(Nd_{0.566}Ce_{0.434})_2Fe_{14}B$ | 17 |
| 0.5 | $(Nd_{0.5}Ce_{0.5})_{13.5}Fe_{76.2}Co_4B_{5.8}Ga_{0.5}$ | — | — | — | — | $(Nd_{0.5}Ce_{0.5})_{13.5}Fe_{76.2}Co_4B_{5.8}Ga_{0.5}$ | 9.6 |
| 0.25 | $(Nd_{0.75}Ce_{0.25})_{13.5}Fe_{76.2}Co_4B_{5.8}Ga_{0.5}$ | 700 | $Nd_{70}Cu_{30}$ | $(Nd_{0.85}Ce_{0.15})_2Fe_{14}B$ | $(Nd_{0.75}Ce_{0.25})_2Fe_{14}B$ | $(Nd_{0.755}Ce_{0.245})_2Fe_{14}B$ | 20 |
| 0.25 | $(Nd_{0.75}Ce_{0.25})_{13.5}Fe_{76.2}Co_4B_{5.8}Ga_{0.5}$ | 650 | $Nd_{70}Cu_{30}$ | $(Nd_{0.85}Ce_{0.15})_2Fe_{14}B$ | $(Nd_{0.75}Ce_{0.25})_2Fe_{14}B$ | $(Nd_{0.755}Ce_{0.245})_2Fe_{14}B$ | 20 |
| 0.25 | $(Nd_{0.75}Ce_{0.25})_{13.5}Fe_{76.2}Co_4B_{5.8}Ga_{0.5}$ | 580 | $Nd_{70}Cu_{30}$ | $(Nd_{0.85}Ce_{0.15})_2Fe_{14}B$ | $(Nd_{0.75}Ce_{0.25})_2Fe_{14}B$ | $(Nd_{0.755}Ce_{0.245})_2Fe_{14}B$ | 20 |
| 0.25 | $(Nd_{0.75}Ce_{0.25})_{13.5}Fe_{76.2}Co_4B_{5.8}Ga_{0.5}$ | — | — | — | — | $(Nd_{0.75}Ce_{0.25})_{13.5}Fe_{76.2}Co_4B_{5.8}Ga_{0.5}$ | 14.4 |

As seen from FIG. 12, in the core, the coercive force is lowest when x=1 indicating a highest Ce concentration, and there is also obtained a result that with an increase in the anisotropy of the core, i.e., at x=0.5 and x=0.25, the coercive force becomes high.

In addition, it is demonstrated that the coercive force is saturated at a heat treatment temperature of about 580° C. and even when heat-treated at a higher temperature, the coercive force shows no change in its value.

Figure 13:
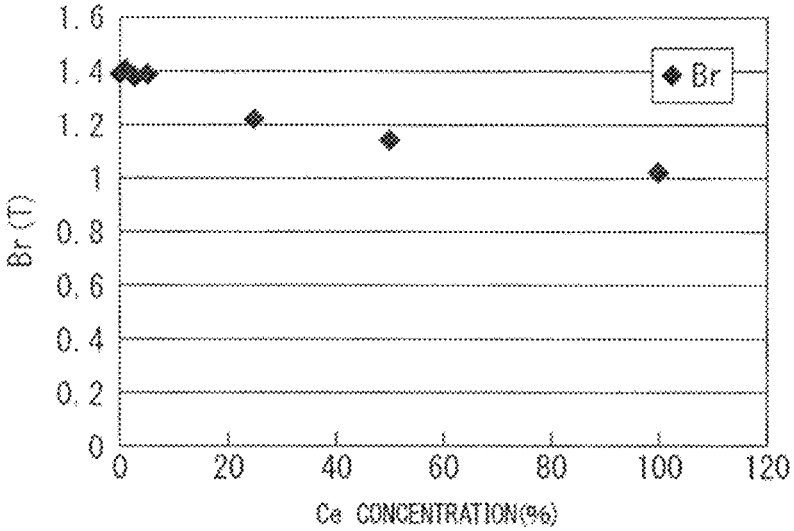
FIG. 13 A view showing the experimental results regarding the relationship between the Ce concentration of the core and the residual magnetization.

On the other hand, as seen from FIG. 13 that is a view showing the experimental results regarding the relationship between the Ce concentration of the core of the crystal grain and the residual magnetization, there is obtained a common-sense result that as the Ce concentration is increased, the residual magnetization is reduced.

Figure 14:
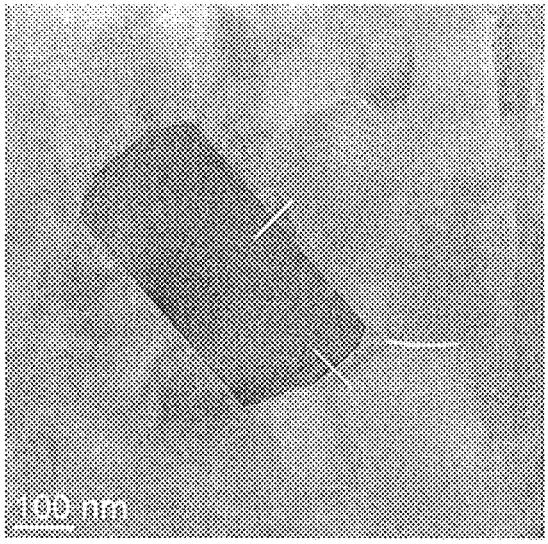
FIG. 14 A TEM image of the crystal grain of the rare earth magnet manufactured by the manufacturing method of the present invention, which is a view illustrating two EDX analysis parts.
Figure 15:
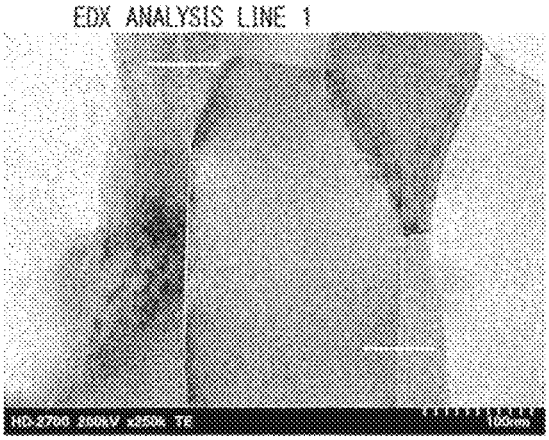
FIG. 15 A TEM image of the crystal grain of the rare earth magnet manufactured by a manufacturing method not including a second step, which is a view illustrating two EDX analysis parts.
Figure 16:
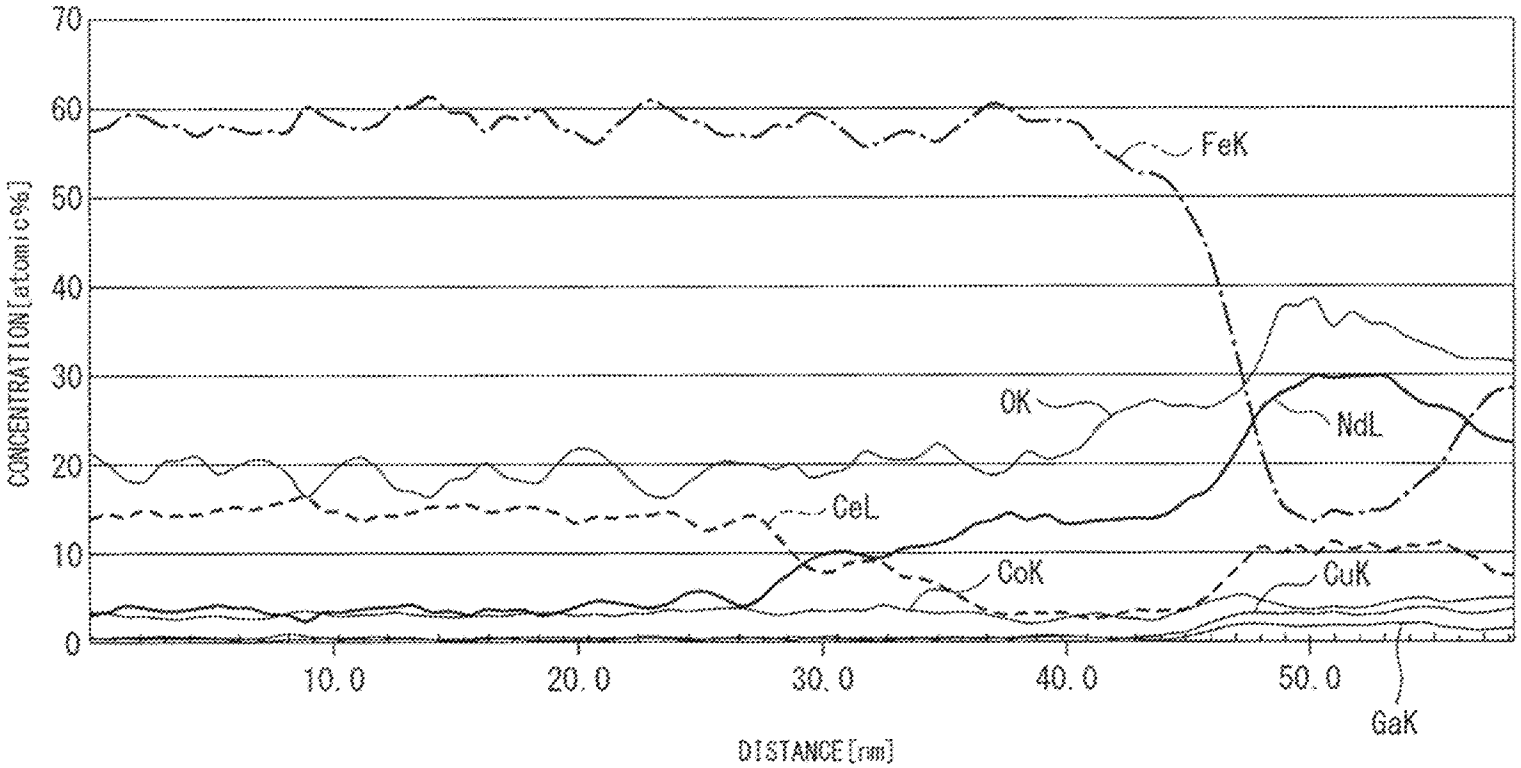
FIG. 16 A view showing the EDX analysis results of line 1 of FIG. 14.
Figure 17:
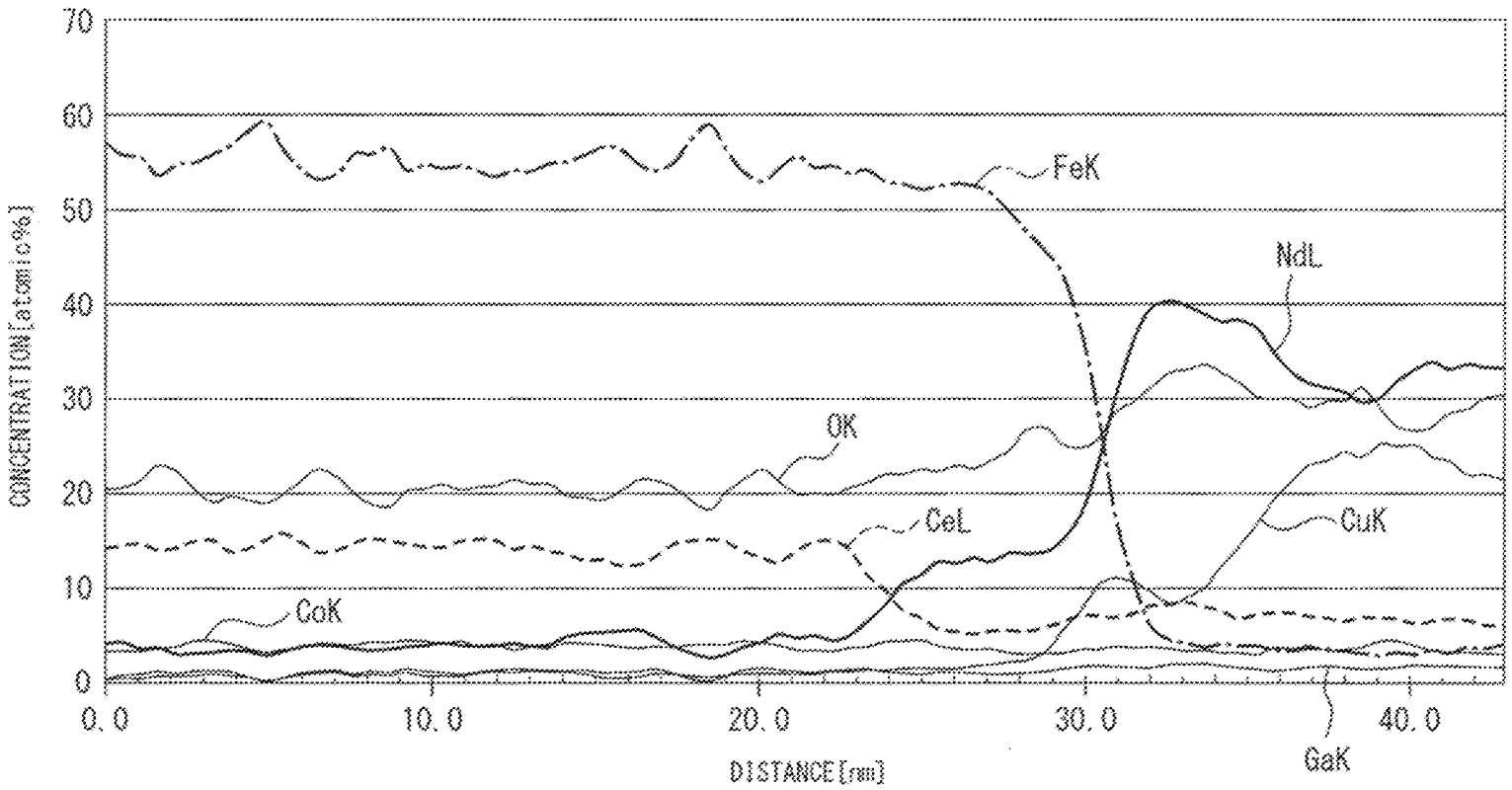
FIG. 17 A view showing the EDX analysis results of line 2 of FIG. 14.
Figure 18:
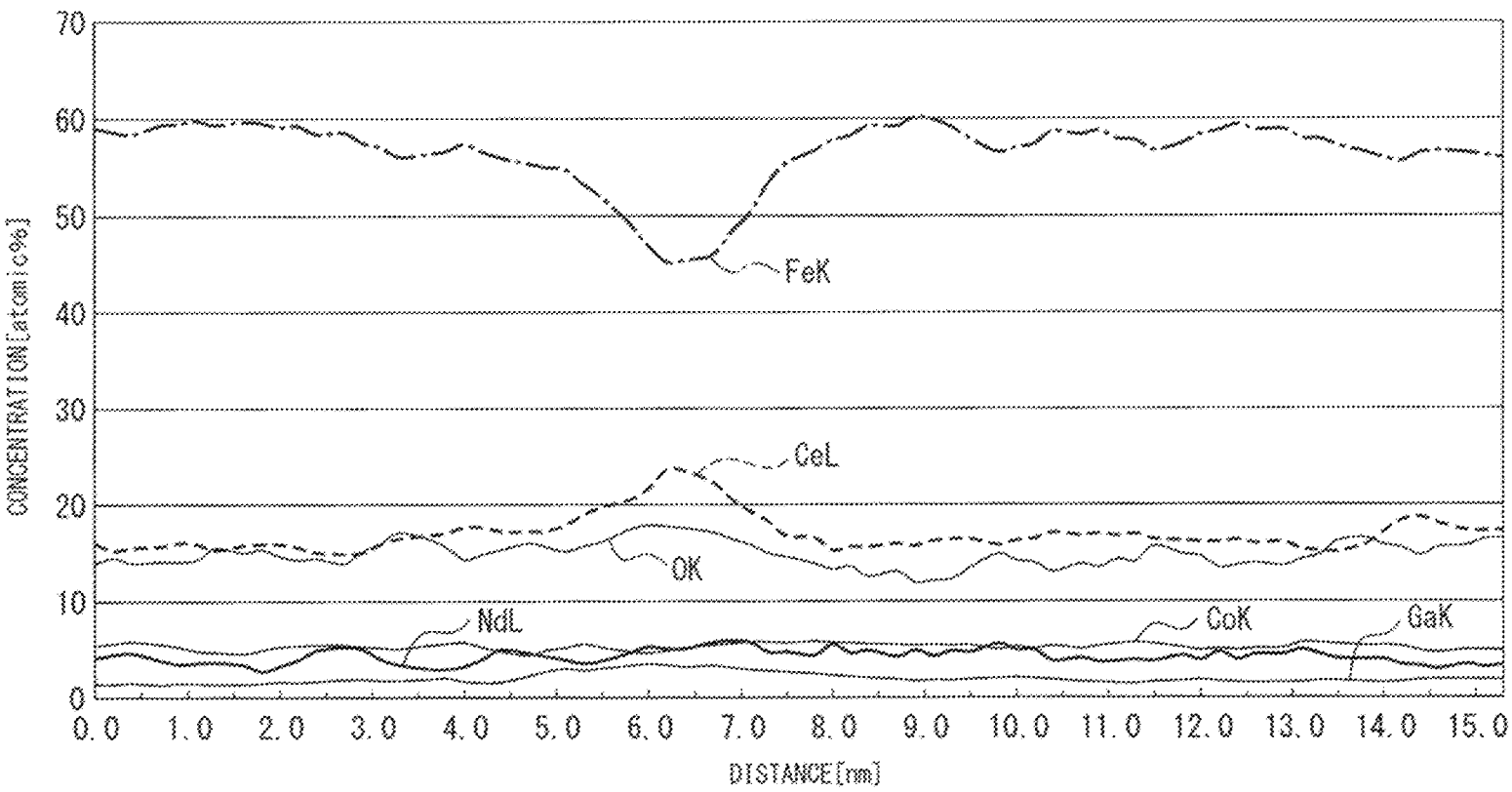
FIG. 18 A view showing the EDX analysis results of line 1 of FIG. 15.
Figure 19:
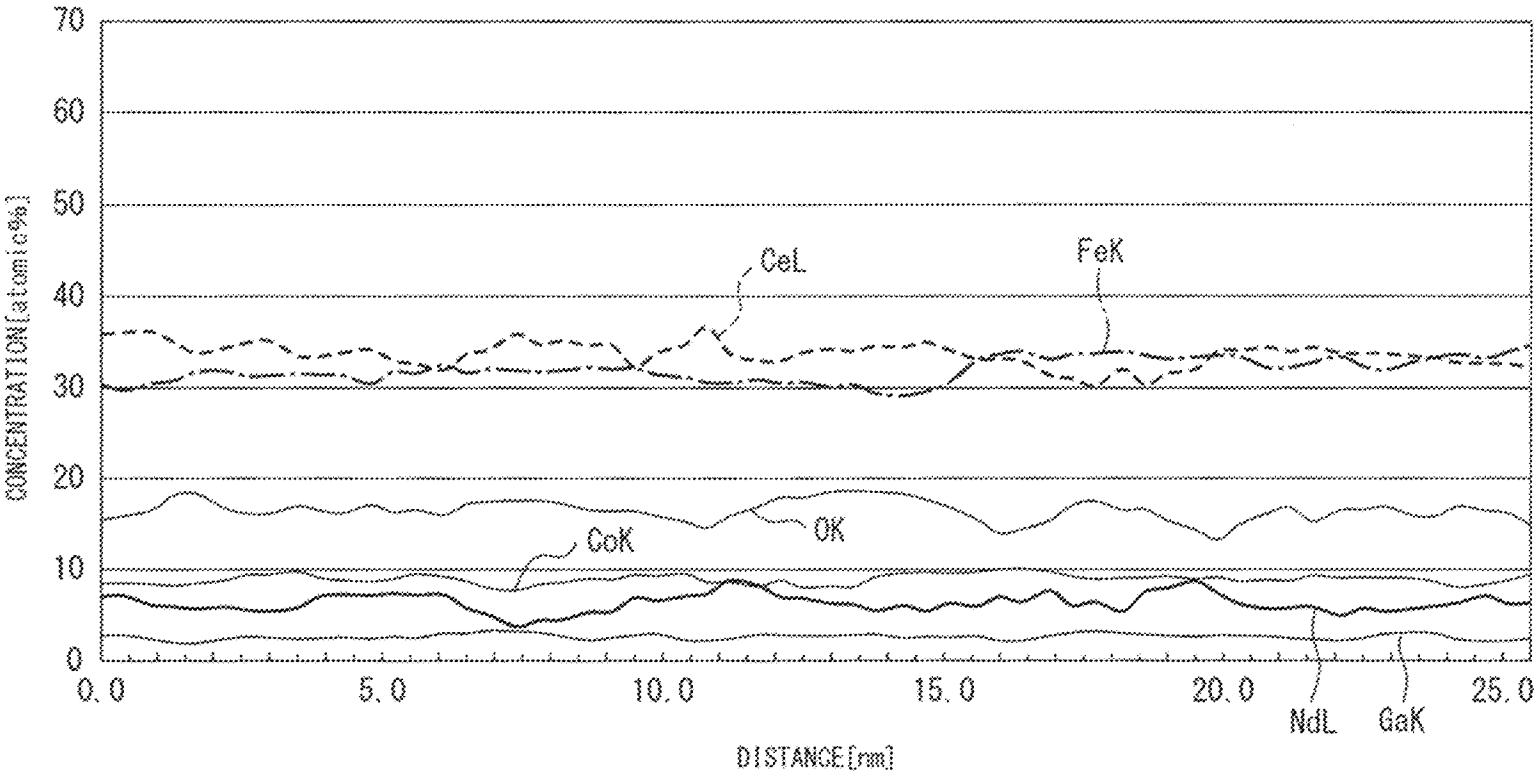
FIG. 19 A view showing the EDX analysis results of line 2 of FIG. 15.

Furthermore, as to the rare earth magnet manufactured by performing only hot plastic working without diffusing and impregnating a modifying metal and the rare earth magnet manufactured by diffusing and impregnating $Nd_{70}Cu_{30}$, respective TEM images were photographed and EDX analysis of each rare earth magnet was conducted. FIG. 14 is a TEM image of the crystal grain of the rare earth magnet manufactured by diffusing and impregnating a modifying metal (Example 1), which is a view illustrating two EDX analysis parts, and FIG. 15 is a TEM image of the crystal grain of the rare earth magnet manufactured without diffusing and impregnating a modifying metal (Comparative Example 4), which is a view illustrating two EDX analysis parts. FIGS. 16 and 17 are views showing the EDX analysis results when the two parts of FIG. 14 were scanned outward, and FIGS. 18 and 19 are views showing the EDX analysis results when the two parts of FIG. 15 were scanned outward.

It can be confirmed from FIGS. 16 and 17 that due to diffusion and impregnation of a modifying metal, an outer shell enriched in Nd is formed on both the a-plane and the c-plane of the crystal grain of the rare earth magnet. On the other hand, as seen from FIGS. 18 and 19, an outer shell owing to enrichment of Nd is not present in the rare earth magnet manufactured by performing only hot plastic working without diffusing and impregnating a modifying metal.

It is demonstrated by this experiment that a crystal grain consisting of a core as a semi-hard phase and an outer shell as a hard phase and having a composite structure of a semi-hard phase and a hard phase, enabling magnetic decoupling between crystal grains, is formed and in turn, a high-performance rare earth magnet utilizing Ce is obtained.

Example 4

Figure 20:
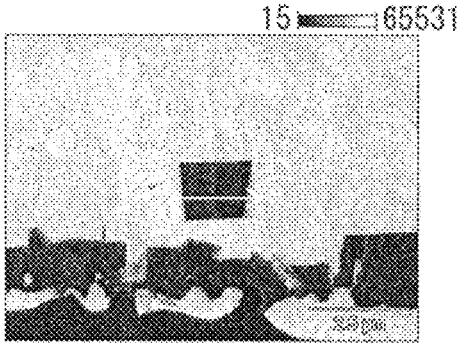
FIG. 20 A view showing the SEM observation results and EDX analysis results in Example 4.
Figure 20:
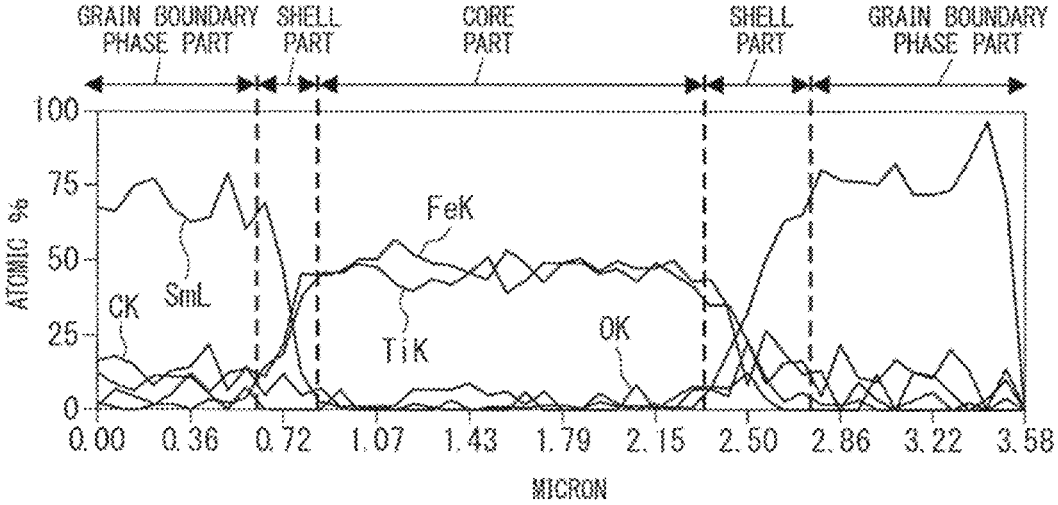

A quenched thin strip of $Sm_{71}Cu_{29}$ alloy was mixed with chemically synthesized Fe nanoparticles (particle diameter: about 100 nm), and the mixture was heat-treated at 800° C. for 30 minutes to obtain a core-shell type magnet. The magnetic properties of the obtained particle were measured by VSM, and the structure was observed by SEM. FIG. 20 shows the SEM observation results and EDX analysis results.

Example 5

Figure 21:
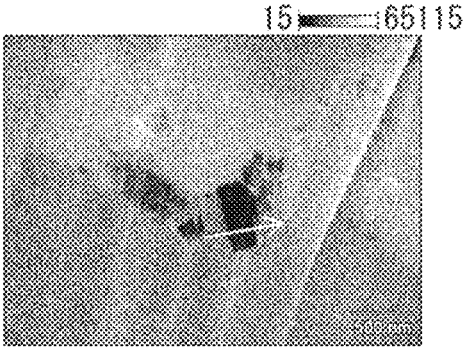
FIG. 21 A view showing the SEM observation results and EDX analysis results in Example 5.
Figure 21:
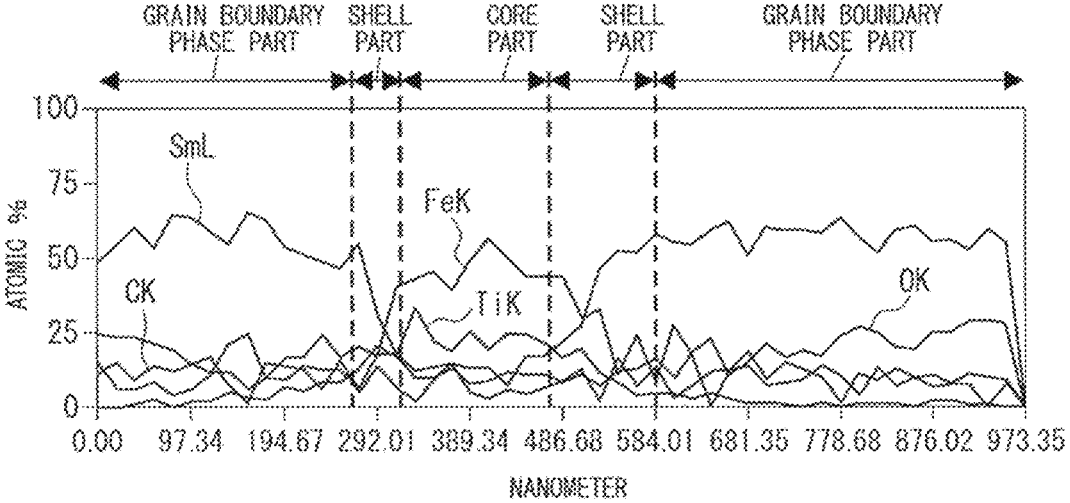

A quenched thin strip of $Sm_{72.5}Fe_{27.5}$ alloy was mixed with chemically synthesized Fe nanoparticles (particle diameter: about 100 nm), and the mixture was heat-treated at 800° C. for 30 minutes. The magnetic properties of the obtained particle were measured by VSM, and the structure was observed by SEM. FIG. 21 shows the SEM observation results and EDX analysis results.

Example 6

Figure 22:
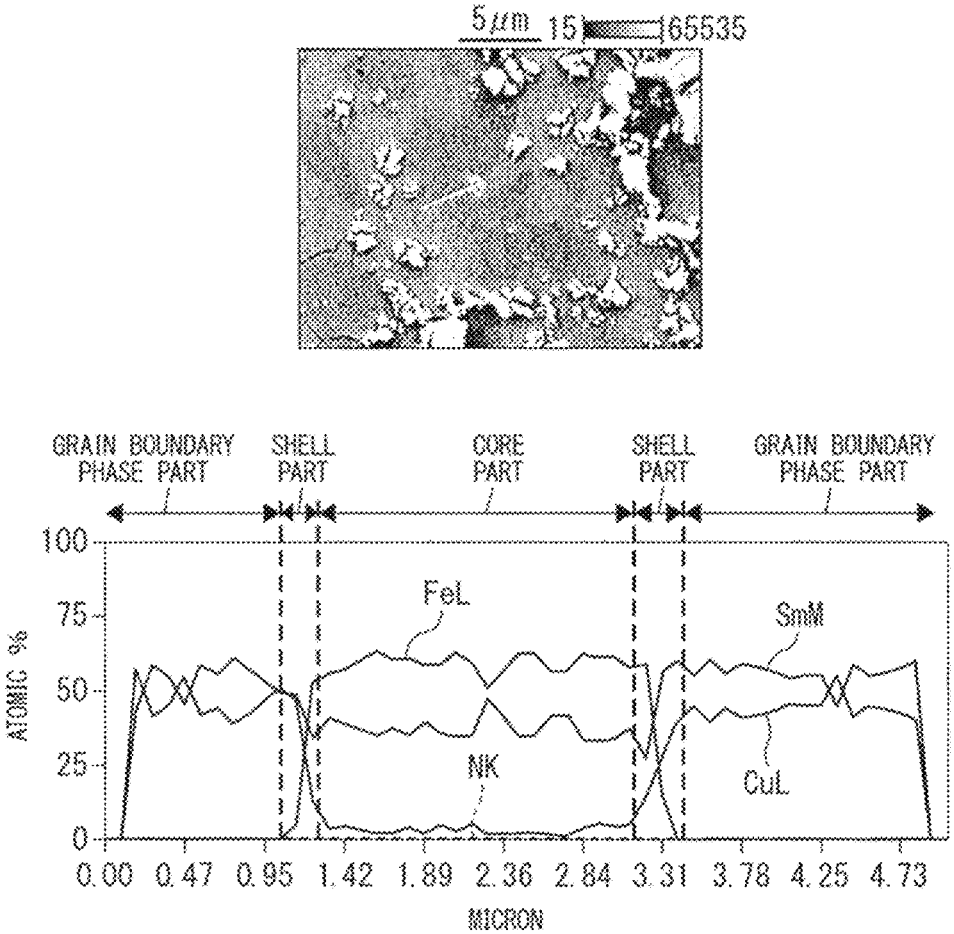
FIG. 22 A view showing the SEM observation results and EDX analysis results in Example 6.

A quenched thin strip of $Sm_{71}Cu_{29}$ alloy was mixed with $Fe_3N$ particles (particle diameter: about 3 μm), and the mixture was heat-treated at 800° C. for 30 minutes. The magnetic properties of the obtained particle were measured by VSM, and the structure was observed by SEM. FIG. 22 shows the SEM observation results and EDX analysis results.

Example 7

A quenched thin strip of $Sm_{72.5}Fe_{27.5}$ alloy was mixed with $Fe_3N$ particles (particle diameter: about 3 μm), and the mixture was heat-treated at 800° C. for 30 minutes. The magnetic properties of the obtained particle were measured by VSM, and the structure was observed by SEM.

Example 8

Figure 23:
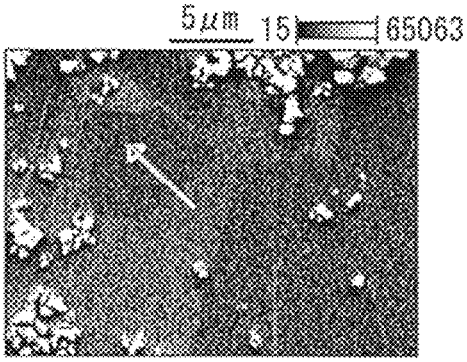
FIG. 23 A view showing the SEM observation results and EDX analysis results in Example 8.
Figure 23:
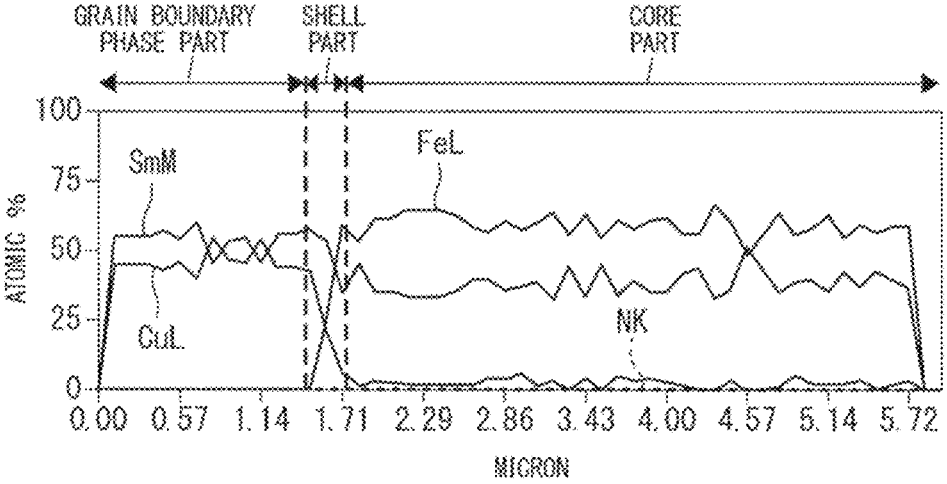

A quenched thin strip of $Sm_{71}Cu_{29}$ alloy was mixed with $Fe_4N$ particles (particle diameter: about 3 μm), and the mixture was heat-treated at 800° C. for 30 minutes. The magnetic properties of the obtained particle were measured by VSM, and the structure was observed by SEM. FIG. 23 shows the SEM observation results and EDX analysis results.

Example 9

A quenched thin strip of $Sm_{72.5}Fe_{27.5}$ alloy was mixed with $Fe_4N$ particles (particle diameter: about 3 μm), and the mixture was heat-treated at 800° C. for 30 minutes. The magnetic properties of the obtained particle were measured by VSM, and the structure was observed by SEM.

Example 10

Figure 24:
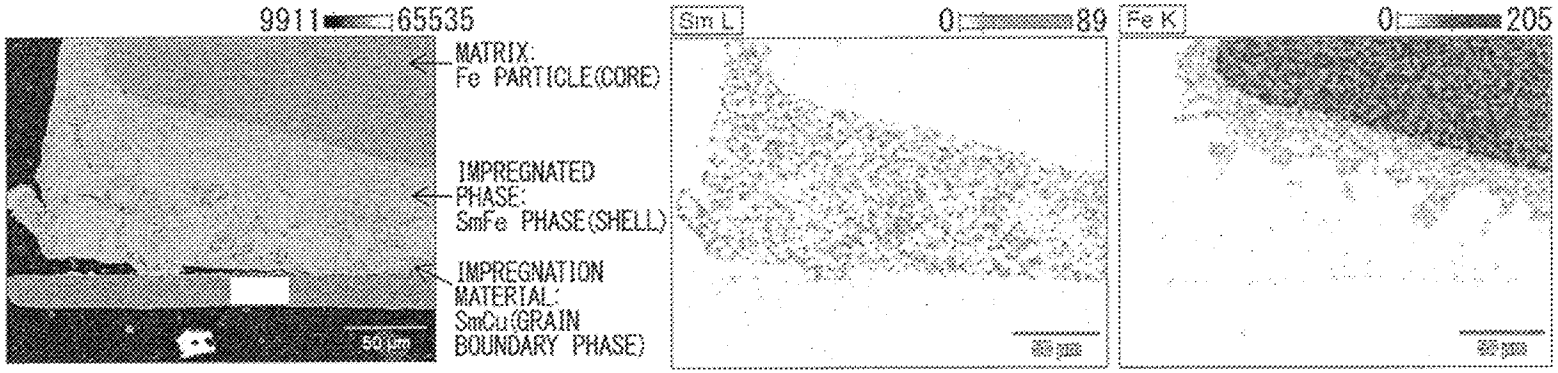
FIG. 24 A view showing the SEM observation results and EDX analysis results in Example 10.

A quenched thin strip of $Sm_{71}Cu_{29}$ alloy was mixed with Fe particles (particle diameter: about 50 μm), and the mixture was heat-treated at 800° C. for 30 minutes. The magnetic properties of the obtained particle were measured by VSM, and the structure was observed by SEM. FIG. 24 shows the SEM observation results and EDX analysis results.

Example 11

Figure 25:
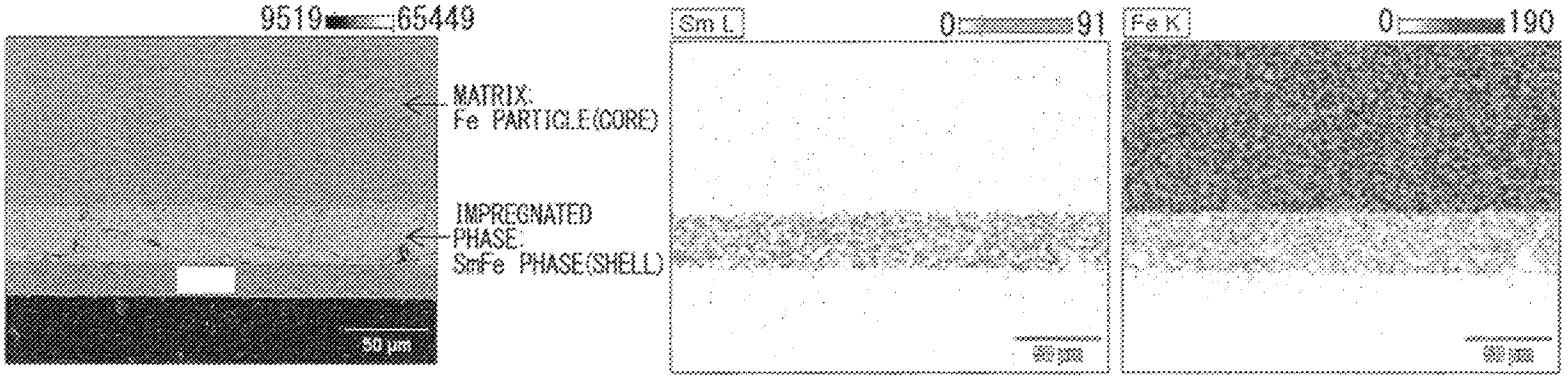
FIG. 25 A view showing the SEM observation results and EDX analysis results in Example 11.

A quenched thin strip of $Sm_{72.5}Fe_{27.5}$ alloy was mixed with Fe particles (particle diameter: about 50 μm), and the mixture was heat-treated at 800° C. for 30 minutes. The magnetic properties of the obtained particle were measured by VSM, and the structure was observed by SEM. FIG. 25 shows the SEM observation results and EDX analysis results.

Example 12

Figure 26:
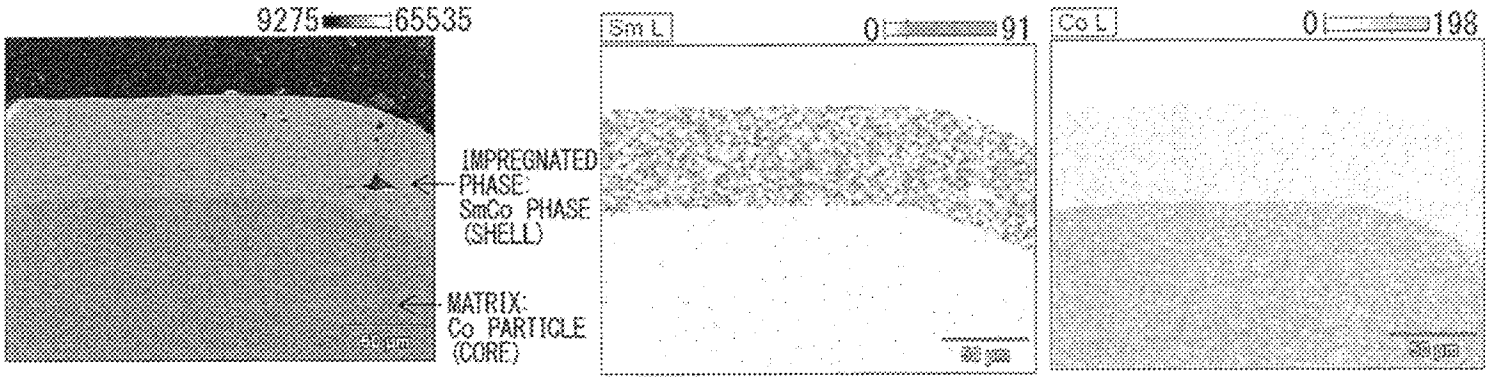
FIG. 26 A view showing the SEM observation results and EDX analysis results in Example 12.

A quenched thin strip of $Sm_{71}Cu_{29}$ alloy was mixed with Co particles (particle diameter: about 50 μm), and the mixture was heat-treated at 800° C. for 30 minutes. The magnetic properties of the obtained particle were measured by VSM, and the structure was observed by SEM. FIG. 26 shows the SEM observation results and EDX analysis results.

Example 13

Figure 27:
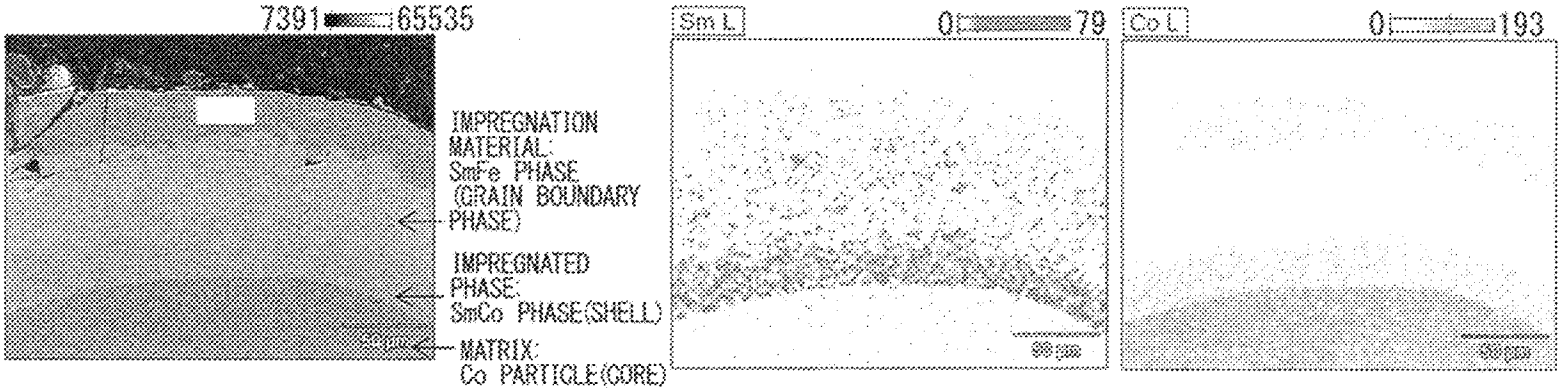
FIG. 27 A view showing the SEM observation results and EDX analysis results in Example 13.

A quenched thin strip of $Sm_{72.5}Fe_{27.5}$ alloy was mixed with Co particles (particle diameter: about 50 μm), and the mixture was heat-treated at 800° C. for 30 minutes. The magnetic properties of the obtained particle were measured by VSM, and the structure was observed by SEM. FIG. 27 shows the SEM observation results and EDX analysis results.

As shown in FIGS. 20 and 21, it is seen from EDX analysis that the Fe nanoparticle was changed to SmFe alloy. In addition, as shown, for example, in FIG. 24, it is found from EDX analysis that an Fe particle as the matrix works out to a core, SmFe as the reaction phase forms an outer shell, and SmCu as the remaining impregnation material is present further outside thereof.

Example 14

A quenched thin strip of $Nd_{70}Cu_{30}$ alloy was mixed with $Fe_{92}B_8$ particles, and the mixture was heat-treated at 580° C. for 30 minutes. The magnetic properties of the obtained particle were measured by VSM, and the structure was observed by SEM.

Example 15

A quenched thin strip of $Nd_{70}Cu_{30}$ alloy was mixed with $Fe_{83}B_{17}$ particles, and the mixture was heat-treated at 580° C. for 30 minutes. The magnetic properties of the obtained particle were measured by VSM, and the structure was observed by SEM.

Example 16

A quenched thin strip of $Nd_{70}Cu_{30}$ alloy was mixed with $Fe_{67}B_{33}$ particles, and the mixture was heat-treated at 580° C. for 30 minutes. The magnetic properties of the obtained particle were measured by VSM, and the structure was observed by SEM.

The evaluations results of magnetic properties are shown together in Table 3 below. All starting substances were a soft magnetic material having no coercive force (0 kOe) before impregnation, but those brought into contact with an impregnation material became a hard magnetic phase by more or less developing a coercive force.

TABLE 3

| No | Composition of Core | Composition of Outer Shell | Impregnation Material | Overall Composition | Coercive Force (kOe) |
|---|---|---|---|---|---|
| 4 | Fe | $Sm_2Fe_{17}$ | $Sm_{71}Cu_{29}$ | $Sm_2Fe_{23}$ | 4 |
| 5 | Fe | $Sm_2Fe_{17}$ | $Sm_{72.5}Fe_{27.5}$ | $Sm_2Fe_{23}$ | 1 |
| 6 | $Fe_3N$ | $Sm_2Fe_{17}N_3$ | $Sm_{71}Cu_{29}$ | $Sm_2Fe_{23}N_3$ | 15 |
| 7 | $Fe_3N$ | $Sm_2Fe_{17}N_3$ | $Sm_{72.5}Fe_{27.5}$ | $Sm_2Fe_{23}N_3$ | 5 |
| 8 | $Fe_3N$ | $Sm_2Fe_{17}N_3$ | $Sm_7Cu_{29}$ | $Sm_2Fe_{23}N_3$ | 1 |
| 9 | $Fe_3N$ | $Sm_2Fe_{17}N_3$ | $Sm_{72.5}Fe_{27.5}$ | $Sm_2Fe_{23}N_3$ | 1 |
| 10 | Fe | $Sm_2Fe_{17}$ | $Sm_{71}Cu_{29}$ | $Sm_2Fe_{23}$ | 1 |
| 11 | Fe | $Sm_2Fe_{17}$ | $Sm_{72.5}Fe_{27.5}$ | $Sm_2Fe_{23}$ | 1 |
| 12 | Co | $SmCo_5$ | $Sm_{71}Cu_{29}$ | $SmCo_{10}$ | 1 |
| 13 | Co | $SmCo_5$ | $Sm_{72.5}Fe_{27.5}$ | $SmCo_{10}$ | 1 |
| 14 | Fe or $Fe_xB$ | $Nd_2Fe_{14}B$ | $N_{70}Cu_{30}$ | $Nd_{3.8}Fe_{88.5}B_{7.7}$—$Nd_0Fe_{92}B_8$ | 13.8 |
| 15 | Fe or $Fe_xB$ | $Nd_2Fe_{14}B$ | $N_{70}Cu_{30}$ | $Nd_{7.8}Fe_{76.5}B_{15.7}$—$Nd_0Fe_{83}B_{17}$ | 15.5 |
| 16 | Fe or $Fe_xB$ | $Nd_2Fe_{14}B$ | $N_{70}Cu_{30}$ | $Nd_{14.2}Fe_{57.5}B_{28.3}$—$Nd_0Fe_{97}B_{33}$ | 10 |

DESCRIPTION OF NUMERICAL REFERENCES

1: Core, 2: outer shell, 10: crystal grain: 20: grain boundary, and 100: rare earth magnet.

The invention claimed is:

1. A method for manufacturing a rare earth magnet, comprising:

a first step of performing hot pressing by using a magnetic powder having a composition of $(R2_{(1-x)}R1_x)_y Fe_{100-y-y-w-z-v}Co_wB_zTM_v$, wherein R2 is at least one of Nd and Pr, R1 is an alloy of at least one or two or more of Ce, La, Gd, Y and Sc, TM is at least one of Ga, Al, Cu, Au, Ag, Zn, In and Mn, $0<x\leq1$ in molar ratio, and y=12 to 20, z=5.6 to 6.5, w=0 to 8, and v=0 to 2, in molar percentage; to produce a rare earth magnet precursor, and a second step of diffusing and impregnating a modifying metal composed of an R2 element or an R2-TM alloy into the rare earth magnet precursor to manufacture a rare earth magnet comprising a crystal grain having an average grain size of 1,000 nm or less and consisting of a core and an outer shell, the core having a composition of R1 that is richer than R2, or a composition in which the concentrations of R1 and R2 are the same and the outer shell having a composition of R2 that is richer than R1.

2. A method for manufacturing a rare earth magnet, comprising:

a first step of performing hot pressing by using a magnetic powder having a composition of $(R2_{(1-x)}R1_x)_y Fe_{100-y-y-w-z-v}Co_wB_zTM_v$, wherein R2 is at least one of Nd and Pr, R1 is an alloy of at least one or two or more of Ce, La, Gd, Y and Sc, TM is at least one of Ga, Al, Cu, Au, Ag, Zn, In and Mn, $0<x\leq1$ in molar ratio, and y=12 to 20, z=5.6 to 6.5, w=0 to 8, and v=0 to 2, in molar percentage to produce a rare earth magnet precursor, and a second step of diffusing and impregnating a modifying metal composed of an R2 element or an R2-TM alloy into the rare earth magnet precursor to manufacture a rare earth magnet comprising a crystal grain having an average grain size of 1,000 nm or less, consisting of a core and an outer shell, and having a composition of R1/(R2+R1) in the core that is larger than R1/(R2+R1) in the outer shell.

3. A method for manufacturing a rare earth magnet, comprising:

a first step of performing hot pressing by using a magnetic powder having a composition of $(Nd_{(1-x)}Ce_x)_y Fe_{100-y-w-z-v}Co_wB_zTM_v$, wherein TM is at least one of Ga, Al, Cu, Au, Ag, Zn, In and Mn, $0<x\leq1$ in molar ratio, and y=12 to 20, z=5.6 to 6.5, w=0 to 8, and v=0 to 2 a, in molar percentage; to produce a rare earth magnet precursor, and a second step of diffusing and impregnating a modifying metal composed of an Nd element or an Nd-TM alloy into the rare earth magnet precursor to manufacture a rare earth magnet comprising a crystal grain having an average grain size of 1,000 nm or less and consisting of a core and an outer shell, and having a composition of Ce/(Nd+Ce) in the core that is larger than Ce/(Nd+Ce) in the outer shell.

4. The method according to claim 1, wherein the Ce/(Nd+Ce) in the core is 0.25 or more and 1 or less.

5. The method according to claim 2, wherein the Ce/(Nd+Ce) in the core is 0.25 or more and 1 or less.

6. The method according to claim 3, wherein the Ce/(Nd+Ce) in the core is 0.25 or more and 1 or less.

7. The method for manufacturing a rare earth magnet according to claim 1, wherein in the first step, hot press working is performed to produce a compact and the compact is subjected to hot plastic working to produce a rare earth magnet precursor.

8. The method for manufacturing a rare earth magnet according to claim 2, wherein in the first step, hot press working is performed to produce a compact and the compact is subjected to hot plastic working to produce a rare earth magnet precursor.

9. The method for manufacturing a rare earth magnet according to claim 3, wherein in the first step, hot press working is performed to produce a compact and the compact is subjected to hot plastic working to produce a rare earth magnet precursor.

10. The method for manufacturing a rare earth magnet according to claim 1, wherein the average grain size of the crystal grain is 500 nm or less.

11. The method for manufacturing a rare earth magnet according to claim 2, wherein the average grain size of the crystal grain is 500 nm or less.

12. The method for manufacturing a rare earth magnet according to claim 3, wherein the average grain size of the crystal grain is 500 nm or less.

* * * * *